US011842656B2

(12) United States Patent
Hewitt

(10) Patent No.: US 11,842,656 B2
(45) Date of Patent: Dec. 12, 2023

(54) THREE-DIMENSIONAL DISPLAY

(71) Applicant: Freshcut Paper, LLC, Concord, MA (US)

(72) Inventor: Peter Hewitt, Acton, MA (US)

(73) Assignee: Freshcut Paper, LLC, Concord, MA (US)

( * ) Notice: Subject to any disclaimer, the term of this patent is extended or adjusted under 35 U.S.C. 154(b) by 0 days.

(21) Appl. No.: 17/193,305

(22) Filed: Mar. 5, 2021

(65) Prior Publication Data

US 2022/0157199 A1 May 19, 2022

Related U.S. Application Data

(60) Provisional application No. 63/115,003, filed on Nov. 17, 2020.

(51) Int. Cl.

| | |
|---|---|
| ***G09F 1/06*** | (2006.01) |
| ***G09F 1/08*** | (2006.01) |
| ***B44C 5/06*** | (2006.01) |

(52) U.S. Cl.

CPC ..... *G09F 1/08* (2013.01); *B44C 5/06* (2013.01); *G09F 1/06* (2013.01)

(58) Field of Classification Search

CPC ... G09F 1/08; G09F 1/06; G09F 1/065; G09F 2001/085; B44C 5/06; B42D 15/04; B42D 15/045; B42D 15/042; A41G 1/00

USPC ..... 40/124.08

See application file for complete search history.

(56) References Cited

U.S. PATENT DOCUMENTS

| | | | | |
|---|---|---|---|---|
| 2,404,089 | A | 7/1946 | Pollock | |
| 2,749,657 | A | 6/1956 | Lohnes | |
| 2,824,394 | A | 2/1958 | Lohnes | |
| 2,884,738 | A | 5/1959 | Lohnes et al. | |
| 2,988,845 | A | 6/1961 | McDougall et al. | |
| 3,134,708 | A | 5/1964 | Lohnes | |
| 5,096,751 | A * | 3/1992 | Duchek | B42D 15/042 40/538 |
| 5,752,649 | A | 5/1998 | Weder | |
| 9,475,333 | B2 | 10/2016 | Yeh | |
| 9,524,658 | B1 | 12/2016 | Wise et al. | |
| 9,601,033 | B2 | 3/2017 | Wise et al. | |

(Continued)

OTHER PUBLICATIONS

[No Author Listed] Lovepop Flower Shop. Lovepo Cards. https://www.lovepopcards.com/collections/lovepop-flower-shop. Publicly available at least as early as Nov. 17, 2020, 7 pages.

(Continued)

*Primary Examiner* — Cassandra Davis

(74) *Attorney, Agent, or Firm* — Wolf, Greenfield & Sacks, P.C.

(57) ABSTRACT

Embodiments disclosed herein include a three-dimensional display, such as a flower bouquet, that is arranged to be popped open. The three-dimensional display includes an outer layer and one or more elastomeric or biasing members arranged pop open and/or to hold the display in the open position. In some embodiments, the outer layer includes flower with stems and leaves. In some embodiments, the bouquet includes inner layers attachable to the outer layer. In some embodiments, the elastomeric or biasing member includes one or more elastic bands. In some embodiments, the three-dimensional display may be popped open by pressing the side panels of the display.

17 Claims, 24 Drawing Sheets

(56) References Cited

U.S. PATENT DOCUMENTS

| | | | | |
|---|---|---|---|---|
| 9,715,840 | B1 * | 7/2017 | Warmus | G09F 1/065 |
| 9,734,734 | B2 * | 8/2017 | Lyon | G09F 1/065 |
| 9,842,516 | B2 | 12/2017 | Yeh | |
| D832,917 | S | 11/2018 | Jiao | |
| D852,882 | S | 7/2019 | Rose | |
| D854,081 | S | 7/2019 | Jiao | |
| D854,614 | S | 7/2019 | Jiao | |
| 10,339,838 | B2 | 7/2019 | Wise et al. | |
| 10,388,189 | B2 | 8/2019 | Rose et al. | |
| D867,448 | S | 11/2019 | Yue | |
| 11,127,316 | B2 * | 9/2021 | Nejad | B42D 15/042 |
| D940,585 | S * | 1/2022 | Karpiel | D11/143 |
| 2012/0285861 | A1 | 11/2012 | Glass et al. | |
| 2015/0332611 | A1 | 11/2015 | Yeh | |
| 2018/0344056 | A1 * | 12/2018 | Ferrer-Walsh | G09F 7/16 |
| 2020/0070562 | A1 | 3/2020 | Nejad et al. | |
| 2020/0074887 | A1 | 3/2020 | Nejad et al. | |
| 2022/0061440 | A1 * | 3/2022 | Karpiel | A41G 1/00 |

OTHER PUBLICATIONS

Extended European Search Report for European Application No. 21161103.3, dated Aug. 31, 2021.

* cited by examiner

THREE-DIMENSIONAL DISPLAY

RELATED APPLICATIONS

This application claims the benefit under 35 U.S.C. § 119(e) to U.S. Provisional Application Ser. No. 63/115,003, entitled "THREE-DIMENSIONAL DISPLAY" and filed Nov. 17, 2020, which is herein incorporated by reference in its entirety.

FIELD

The disclosed embodiments are generally directed to three-dimensional displays and more particularly displays that can be popped open and/or popped up, such as a pop-open flower bouquet.

SUMMARY

According to one embodiment, a three-dimensional display arranged to be popped open is disclosed. The three-dimensional display includes an outer layer having printed images, one or more inner layers having printed images, and one or more elastomeric members attachable to at least the outer layer. The one or more elastomeric members including a first elastomeric member arranged to pop open and/or hold the three-dimensional display in an open position.

According to another embodiment, a method of forming a three-dimensional display arranged to be popped open is disclosed. The method includes forming an outer layer having printed images, attaching or more elastomeric members to the outer layer, assembling the outer layer, and inserting one or more inner layers into the outer layer, the one or more inner layers having printed images.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Traditionally, to celebrate someone or to commemorate a special event, flower bouquets may be sent to one or more individuals or to groups of individuals. Because flowers do not last a long time, and/or because some individuals may be allergic to flowers, other types of arrangements have been introduced. For example, greeting cards and other pop-up displays with flowers may be sent instead. Applicant has recognized that pop-open displays, such as pop-open bouquets, may have less negative environmental effect. For example, the disclosed displays may eliminate the need for mass-production of natural flowers. As another example, the disclosed displays may transport more efficiently and may eliminate the usage of chemical fertilizers and pesticide used in commercial flower production. Applicant has also recognized that existing arrangements do not provide a satisfactory solution in all aspects.

Figure 1:
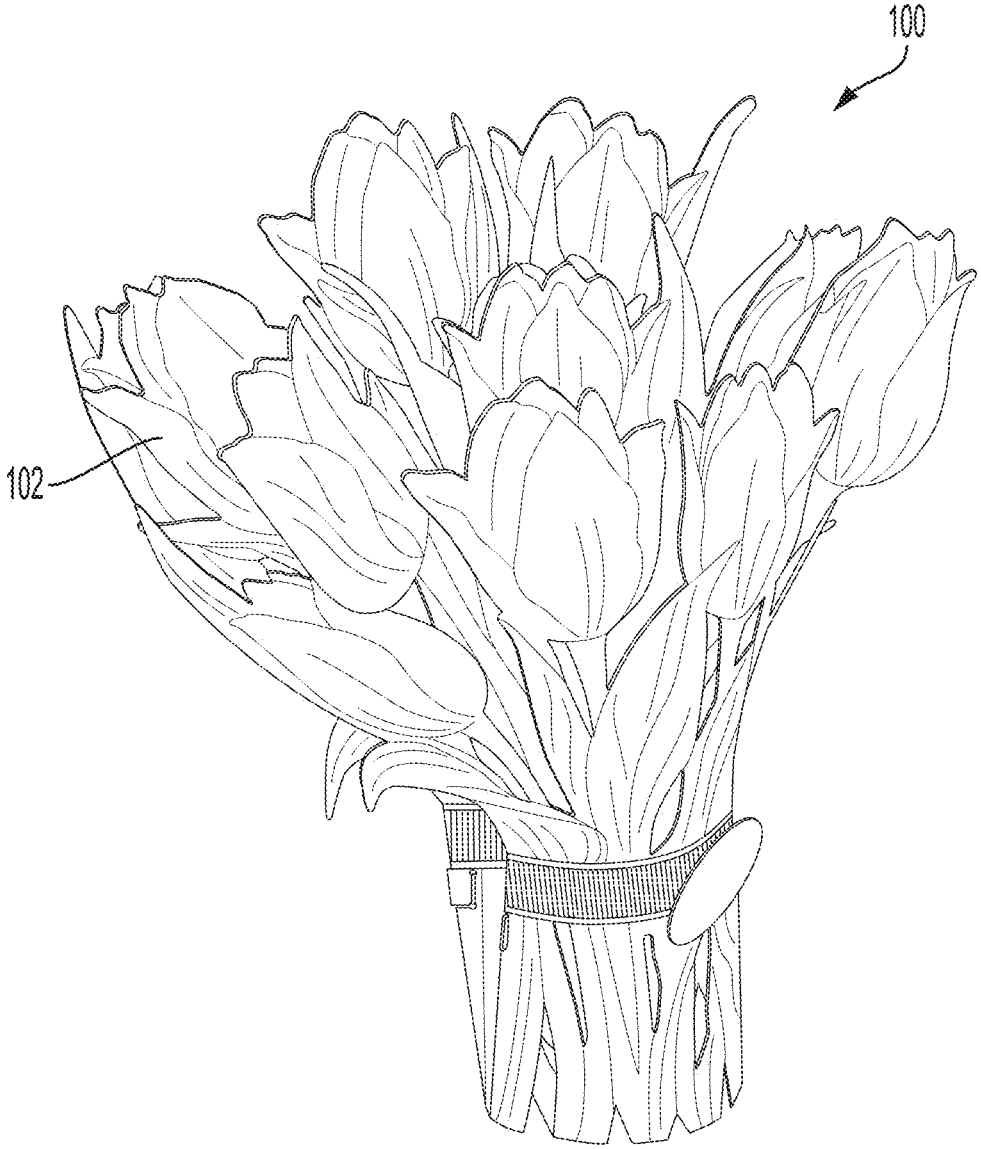
FIG. 1 shows a three-dimensional display according to embodiments of the present disclosure.
Figure 2:
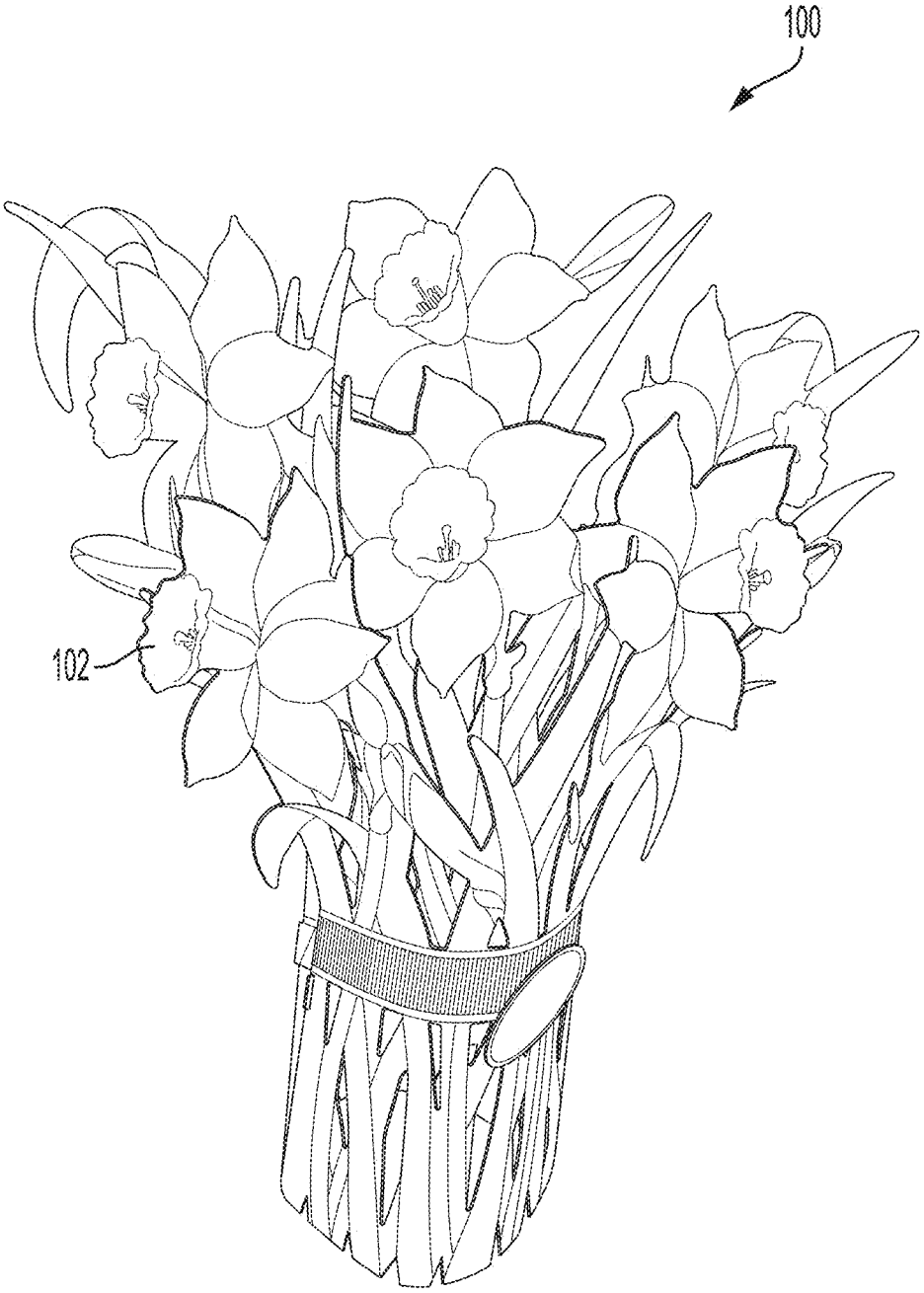
FIG. 2 shows three-dimensional display according to another embodiment.
Figure 3:
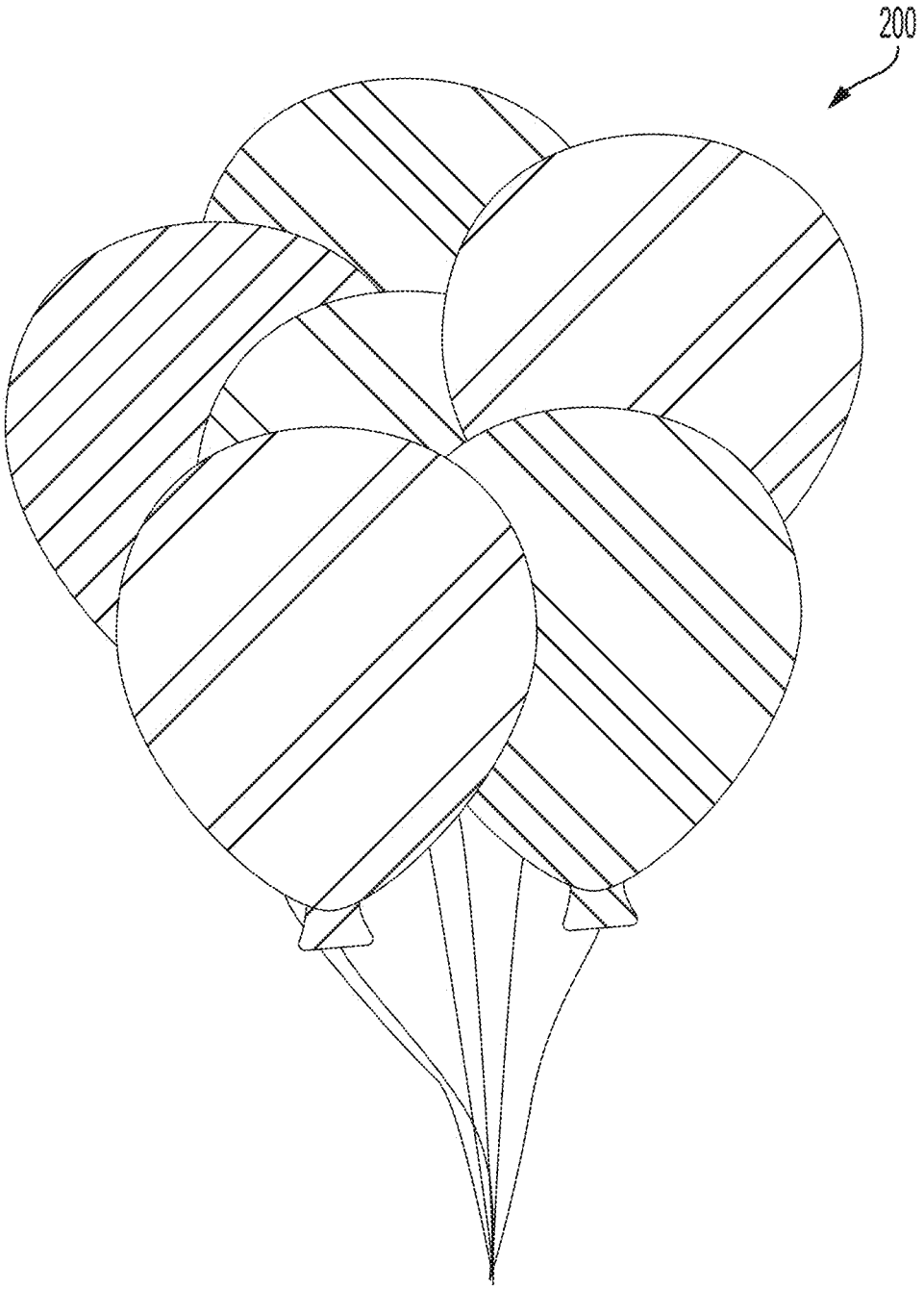
FIG. 3 shows a three-dimensional display according to still other embodiments.

Applicant has recognized that benefits may be realized by including one or more elastomeric or biasing members arranged to help pop-open a three-dimensional (3D) display and/or to maintain the display in the open or 3D position. As shown in FIGS. 1 and 2, for example, in some embodiments of the present disclosure, the 3D display may include a floral bouquet, which may be configured such that the flowers in the bouquet and the bouquet itself look realistic. As shown in these figures, the bouquet may include flowers that are similar in size to real flowers, with each flower have stems and leaves. In some embodiments, the bouquet may stably rest on a surface. In other embodiments, as shown in FIG. 3, the 3D display may include a bouquet of balloons 200.

Accordingly, embodiments disclosed herein include a 3D display with an outer layer and one or more elastomeric or biasing members arranged to help pop open the display and/or to hold the outer layer in an open position. For example, in some embodiments, the display includes a flower bouquet, and the outer layer includes one or more flowers (e.g., flowers printed onto a paper material). In some embodiments, the flowers may include stems and leaves. In some embodiments, the outer layer also may include a ribbon wrapped around the stems of the flowers.

In some embodiments, the one or more elastomeric or biasing members includes one or more elastic bands (also referred to herein as rubber bands). For example, in some embodiments, an elastic band may be attached to the outer layer of the bouquet. In such embodiments, the elastic band may pull a first side of the outer layer towards a second, opposite side of the outer layer to hold the display in the open position. In some embodiments, a first end of a rubber band may be attached to the first side of the outer layer and the second end of the rubber band may be attached to the second side of the outer layer.

In other embodiments, the 3D display may include two elastic bands, each of which is attached to the first and second sides of the outer layer. In some embodiments, the two elastic bands may help create a more rounded or circular appearance to the display, such as to a base of the display (e.g., to the stem region of the bouquet). In such embodiments, this may give the flowers in the display a more realistic appearance. In such embodiments, the two elastic bands may extend substantially parallel to one another. The first and second elastic bands also may be positioned relative to one another in other manners. For example, the elastic bands may cross over one another (e.g., in an "X" arrangement) in some embodiments.

As will be appreciated, the 3D display may include more than 3 elastic bands, with the bands being attached to suitable locations of the outer layer. As will be appreciated, the bouquet may include other arrangements (e.g., springs) to pull the first ands second sides of the outer layer towards one another to hold the bouquet in the open position.

In some embodiments, the elastic band(s) may bias the outer layer of the 3D display into the open position. In such embodiments, the elastic band(s) may be stretched when the outer layer is in a flat or closed positioned. As will be appreciated, the display may be placed inside a holder to maintain the bouquet in the closed position, such as during delivery (e.g., mailing) of the bouquet. In some embodiments, a user may pop open the display from the closed position to the open position by pressing on the sides of the outer layer. In such embodiments, pressing on the sides may urge the elastic band to move (e.g., snap) back to a less stretched position, thus moving the display into the open position. In this open position, the elastic band(s) may still provide tension between the first and second sides of the outer layer.

In some embodiments, the outer layer may be substantially curved when the display is in the open position. In some embodiments, the first and second sides of the outer layer are moved closer to one another and the front and rear of the outer layer are moved further away from one another when in the open position. In some embodiments, such movement allows the display to have a more rounded or circular appearance, such as a base (e.g., stem portion) of the display, when the display is in the open position.

In some embodiments, the display may include one or more inner layers. As with the outer layer, the inner layer(s) may include one or more flowers with stems and leaves. The inner layer also may include only flowers, or flowers and only a portion of the stems. The inner layer also may include other suitable arrangements (e.g., balloons). In some embodiments, the inner layer(s) may be coupled to the outer layers. For example, in some embodiments, the inner layer (s) may include one or more features that engage with the rubber band(s) to hold the inner layer(s) to the outer layer. In some embodiments, the rubber bands may serve to lock the inner layer(s) in place in the bouquet. In other embodiments, the inner layer(s) may be attachable to the outer layer via slits that correspond with slits on the outer layer. In such embodiments, the inner layers may be engaged directly with the outer layer.

In some embodiments, the inner layers form an X-shape when inserted into the outer layer. In some embodiments, the X-shape of the inner layers may urge the outer layer into the open position. In some embodiments, the X-shape of the inner layers also may assist with holding the display in open position. In some embodiments, the elastic band(s) may cooperate with the X-shape of the inner layers to urge the outer layer open and/or to hold the display in the open position.

The outer layer also may include one or more features to encourage popping open of the display and/or to cooperate with the one or more elastomeric and/or biasing members to hold the display in the open position. For example, in some embodiments, the first and second lateral sides of the outer layer may extend inwardly, such as towards a center of the display and towards each other, to encourage the display to pop open and/or hold the display in the open position. In some embodiments, each of the first and lateral sides may be arranged to fold inwardly to form a V-shape, with a respective channel formed therebetween, that may encourage the bouquet to pop open. In some embodiments, the channels may be substantially triangular in cross-sectional shape.

Turning now to the figures, FIGS. 1-3 show illustrative embodiments of pop-open 3D displays according to the present disclosure. As shown in FIGS. 1 and 2, the display may include pop-open flower bouquets 100, in some embodiments. In other embodiments, the display may include pop-open balloons, as shown in FIG. 3.

In some embodiments, as shown in FIGS. 1 and 2, the bouquets may flowers 102 with stems and leaves. In some embodiments, as shown in these views, the bouquet may include a piece of ribbon that may wrap around the stems of the bouquet.

In some embodiments, as shown in FIGS. 1 and 2, the flowers (and corresponding stems and leaves) may be arranged to look like real flowers. For example, the shape and size of the tulips in FIG. 1 are similar to the shape and size of real tulips. As will be appreciated, in other embodiments, the flowers may be made smaller (or larger) that real flowers. In some embodiments, as shown in FIGS. 1 and 2, each bouquet may include only a single type of flower, although the bouquets may include more than one type of flowers in other embodiments. As will be appreciated, as with real bouquets, the flowers in the bouquet may be oriented in different directions and may look different from one another in the bouquet, even though the bouquet may have the same type of flowers.

Figure 4:
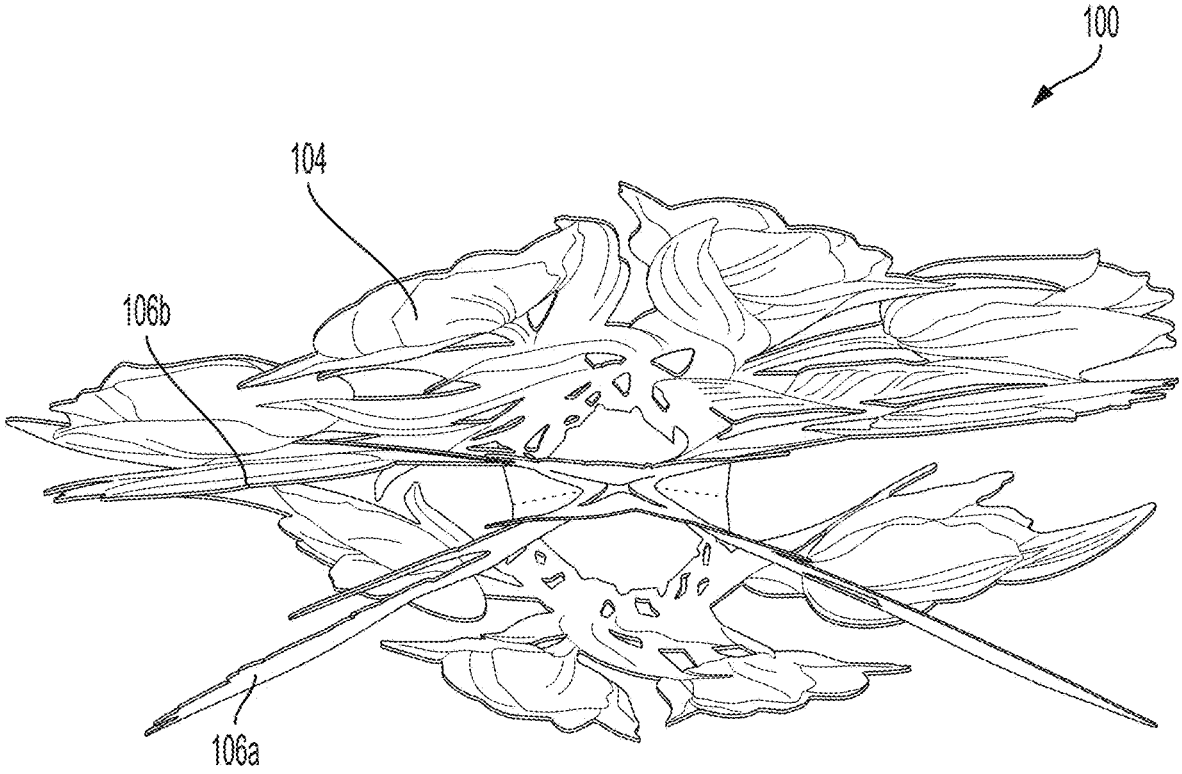
FIG. 4 is a top view of the three-dimensional display of FIG. 1.

As shown in FIG. 4, the bouquet may include one or more layers of flowers. For example, in some embodiments, as shown in this view, the bouquet may include an outer layer 104 and two inner layers 106*a*, 106*b*. In some embodiments, the inner layers may be arranged in an X-shape when inserted in the outer layer and when in the open position (see FIGS. 4 and 5). In some embodiments, the X-shape of the inner layers may hold the outer layer in the open position. The X-shape of the inner layers also may assist with popping open the flower bouquet.

Figure 5:
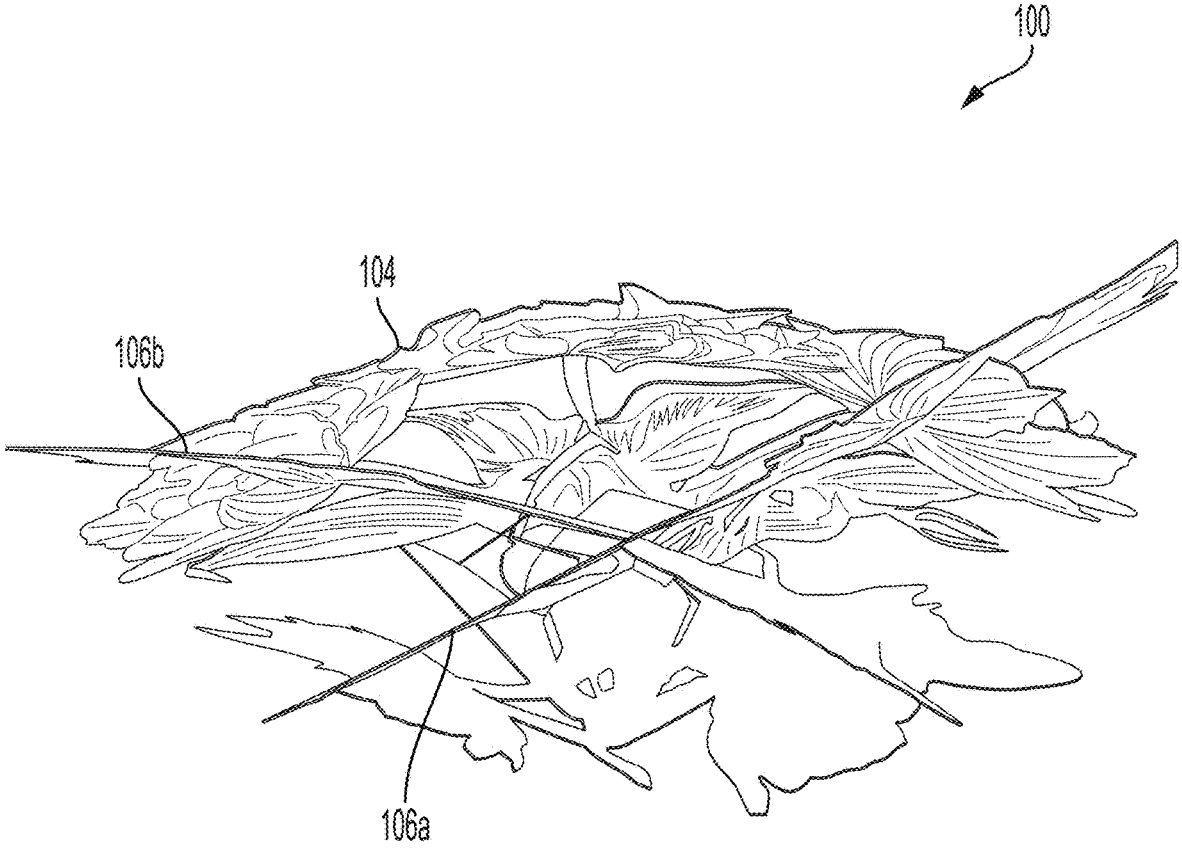
FIG. 5 is a top view of a three-dimensional display according to another embodiment.

Although the bouquets are shown with two inner layers in FIGS. 4 and 5, in other embodiments, the bouquets may include only a single inner layer or may include more than two inner layers. In some embodiments, the inner layers are attachable to one another before insertion into the outer layer, as will be described.

Figure 6:
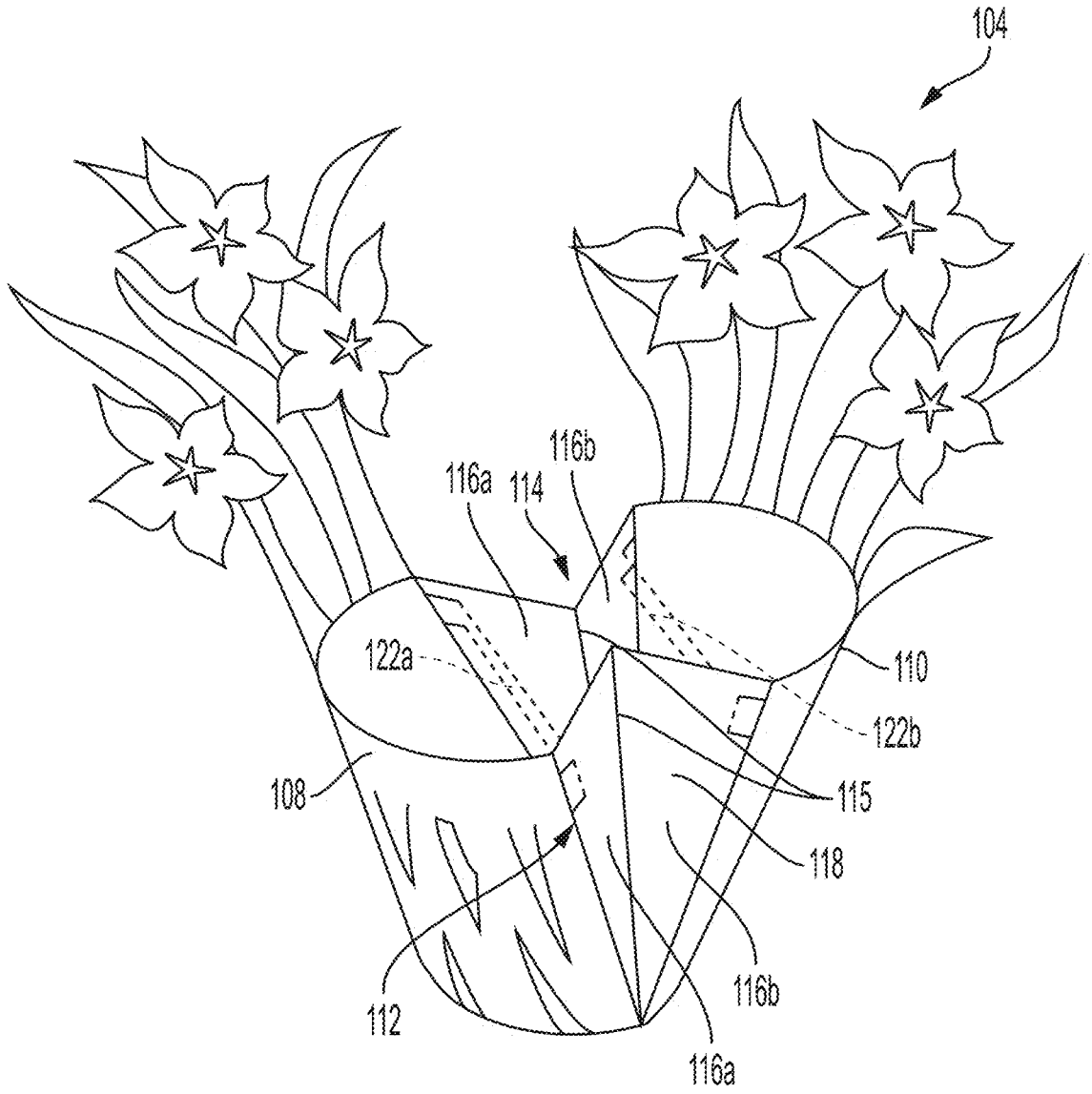
FIG. 6 is a schematic representation of an outer layer of a three-dimensional display according to some embodiments.

FIG. 6 shows a schematic representation of the outer layer of a flower bouquet according to some embodiments of the present disclosure. In some embodiments, as shown in this view, the outer layer may include a front panel with flowers 108, a rear panel with flowers 110, and first and second side panels 112, 114. In some embodiments, as shown in this view, the side panels may be shorter than each of the front and rear panels. For example, the side panels may not have flowers and may have only stems and/or leaves, although the side panels also may have one or more flowers in other embodiments. In some embodiments, the front and rear panels may be substantially the same height, although the front panel may be shorter than the rear panel in some embodiments.

In some embodiments, as shown in FIG. 6, each of the front and rear panels may be curved when the bouquet is in an open position. For example, the front and rear panels may be curved outwardly and in a direction towards the front and rear of the bouquet, respectively. As will be appreciated (see, e.g., FIG. 18), the front and rear panels may be substantially flat when the bouquet is in a closed position.

As also shown in FIG. 6, in some embodiments, the side panels 112, 114 may fold inwardly toward a central region of the bouquet and towards each other. For example, in some embodiments, each of the side panels may include a crease or fold line 115, which divides each panel into first and second segments 116*a*, 116*b*, respectively. In such embodiments, the side panels may fold at the crease to form a V (see also FIG. 7). In some embodiments, the crease lines (and apex of the V) of the side panels may move toward one another. In some embodiments, the crease lines may be arranged to contact each other when the bouquet is in the open position.

Figure 8:
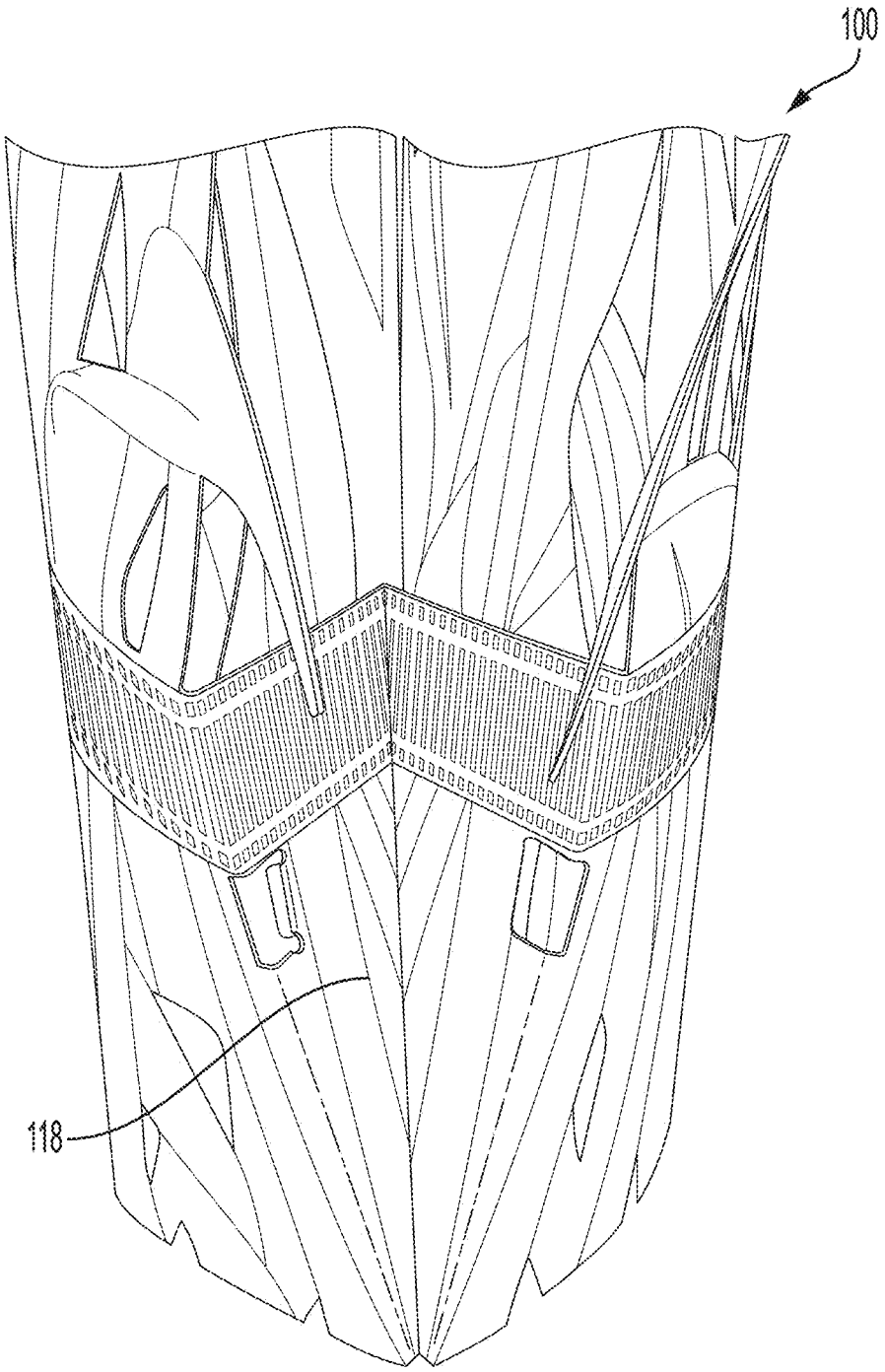
FIG. 8 is a side view of a portion of the display of FIG. 1.

In some embodiments, a channel may be formed between the first and second segments of each side panel. In some embodiments, the channel 118 may extend at least partially between the top and bottom of the side panel. As shown in FIGS. 6 and 8, the channel may extend all the way between the top and bottom of each side panel in some embodiments. In such embodiments, the side panel may be attached to each of the front and rear panels of the bouquet, all the way between the top and bottom of the side panel. In some embodiments, a substantially triangular-shaped channel (e.g., triangular cross-sectional shape) may be formed between the first and second segments of each side panel. In some embodiment, the shape and size of the channel may be different between the top and bottom of the side panel. For example, as shown in FIG. 8, the channel sizes decrease from the top of the channel to the bottom of the channel. In one example, the channel size may taper between the top and bottom of the side panel. In other embodiment, as will be appreciated, the channel may be the same shape and size between the top and bottom of each side panel.

Although a triangular shaped channel is shown between the first and second segments of the side panel in FIGS. 6 and 8, the channel may have other suitable shapes in other embodiments. For example, in some embodiments, the channel may be square, rectangular, or other suitable shape. In such embodiments, as will be further appreciated, the side panel may include more than two segments to form the differently shaped channel (e.g., 3 segments to form the rectangle and/or square shaped channel).

Although the V-shaped channels are shown on the first and second sides panels in FIG. 8, it will be appreciated that other portions of the bouquet may have a V-shaped (or other shaped) panel. For example, in some embodiments, channels may be formed in each side panel and in the rear panel of the outer layer. In this regard, the outer layer may have more than two V-shaped channel in some embodiments. In other embodiments, the outer lay may have only a single V-shaped channel (e.g., on the rear panel of the bouquet. In such embodiments, the side panels may have other arrangements that may not include channels.

Figure 9:
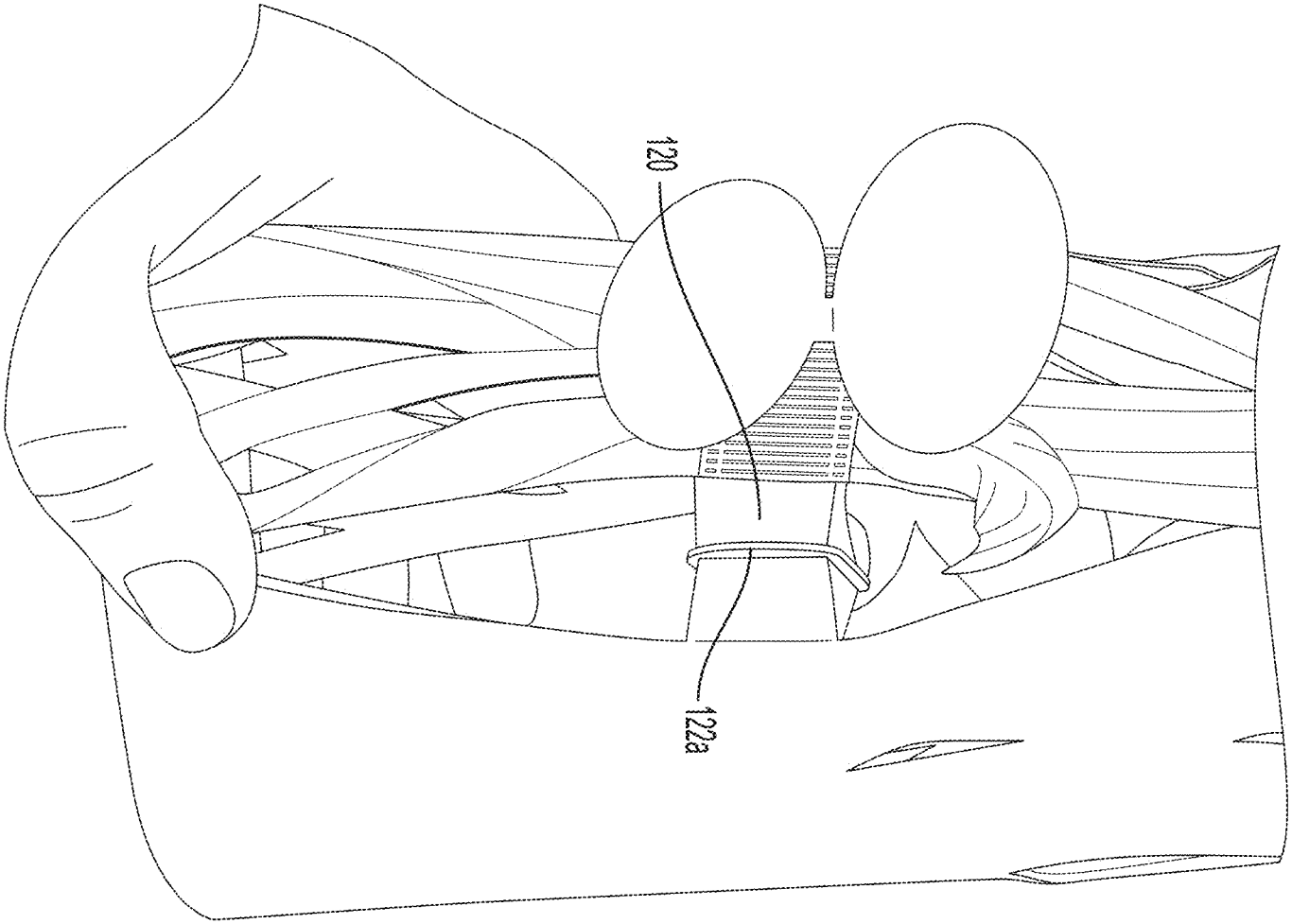
FIG. 9 is a side view of a portion of the display of FIG. 5.

Although the bouquet is shown as having a side panel connecting the front and rear panels of the bouquet, in other embodiments, the front and rear panels may be attachable via other suitable methods. For example, as shown in FIG. 9, the front and rear panels may be attachable via a tab 120. In some embodiments, the tab may be arranged to look like a piece of ribbon extending around the stems of the flower. As shown in FIG. 9, and similar to the prior embodiments, the tab may extend inwardly towards the central region of the bouquet. In some embodiments, the tab may include more than one segment and form a V-shape. A channel (e.g., a triangular-shaped channel) also may be formed between the segments of the tab.

As will be appreciated, the tab may extend along a portion of a length of the outer layer, in between the top and bottom of the outer layer. For example, in some embodiments, the tab may be attached at only the stem region. It will be appreciated that the tab and corresponding channel may be attached at other suitable portions of the bouquet.

Figure 7:
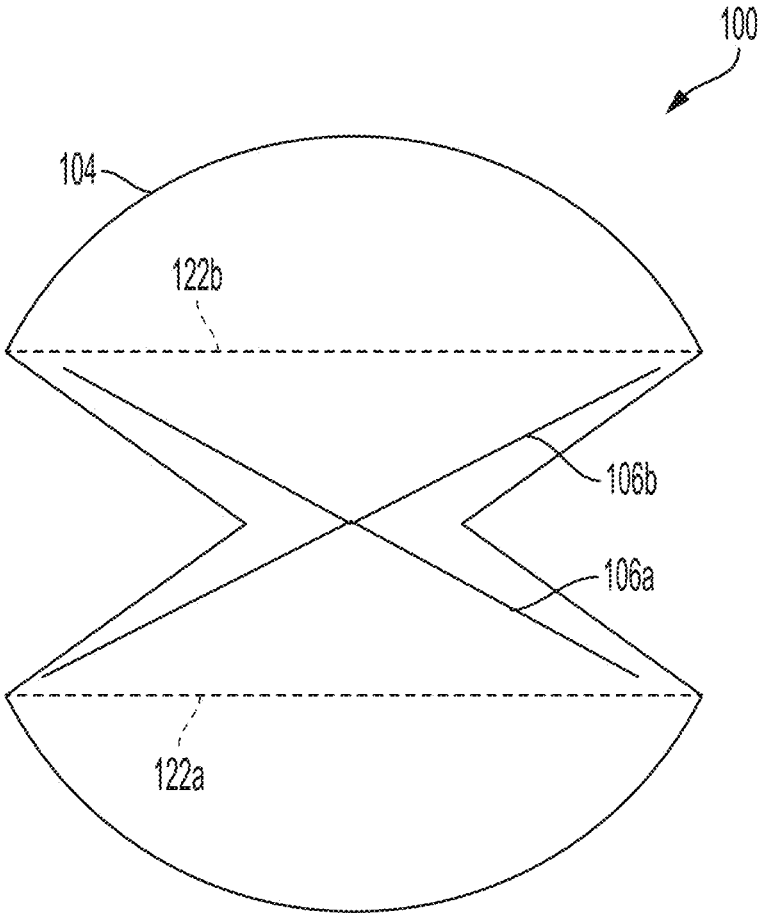
FIG. 7 is a schematic representation of an assembled three-dimensional display according to some embodiments.

According to one aspect of the disclosure, the display may include one or more elastomeric and/or biasing members to encourage the display to pop open and/or to hold the display in the open position. As shown in FIGS. 6 and 7, for example, in some embodiments, the bouquet may include first and second rubber bands 122*a*, 122*b*. In some embodiments, as shown in this view, the rubber bands may be attachable to the side panels 112, 114 of the bouquet. For example, the first elastic band 122*a* may be attachable to the first segment 116*a* of each side panel while the second elastic band 122*b* may be attachable to the second segment 116*b* of each side panel. As will be appreciated, in such embodiments, the elastic bands may move and thereafter hold the crease line 115 of each side panel towards each other when the recipient of the bouquet pushes the first and second side panels towards one another and then releases them.

Although the bouquet is shown as having two rubber bands in some embodiments, in other embodiments (see, e.g., FIG. 9), the bouquet may include only a single rubber band 122*a*. In such embodiments, the rubber band may be attachable to the side panel or to another suitable portion of the bouquet. For example, the rubber band may be attachable to the tab in the embodiment shown in FIG. 9. In such embodiments, the rubber band may extend around the apex of the V of each tab segment to pull the tab segments towards one another.

Figure 10:
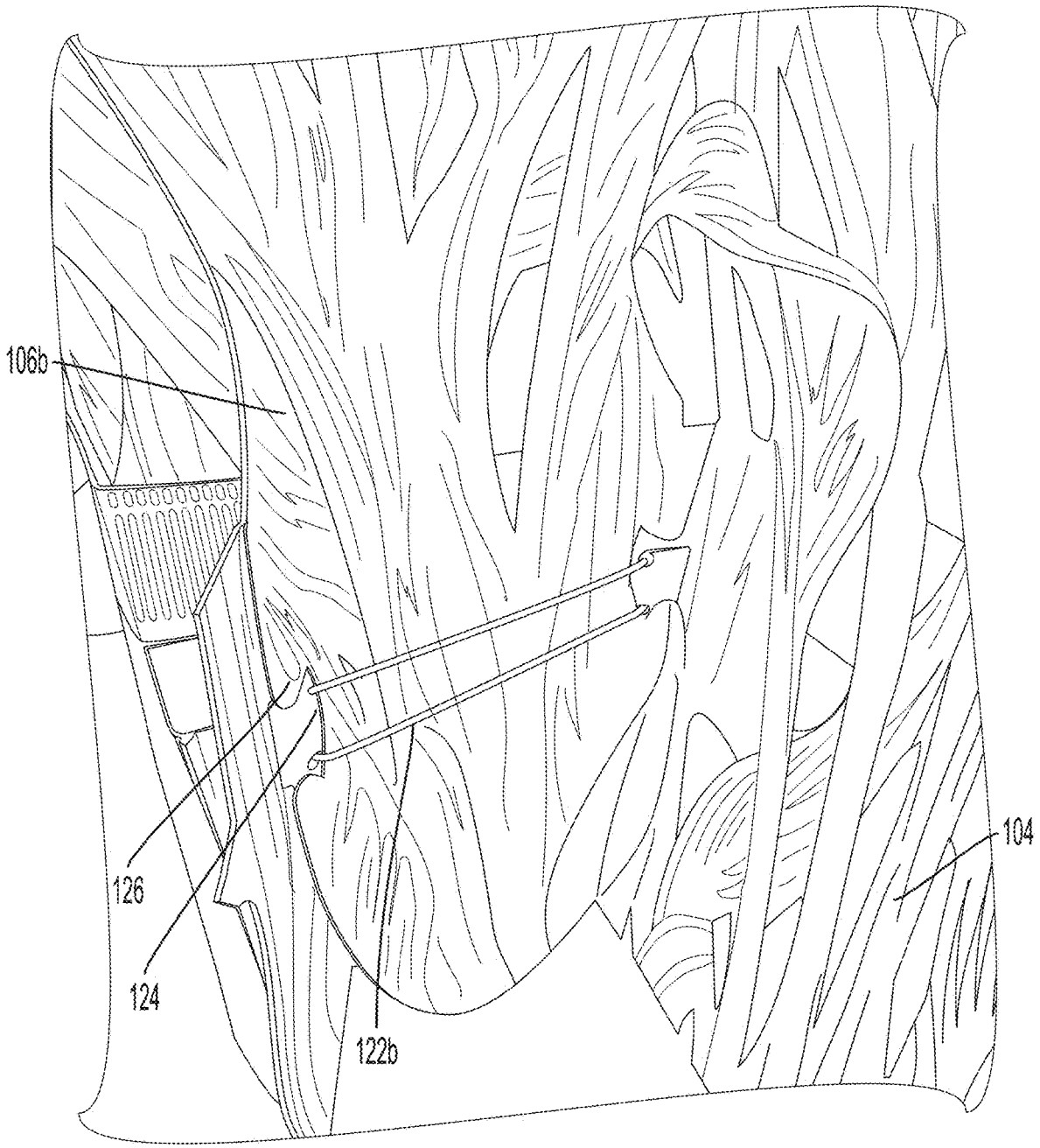
FIG. 10 is the display of FIG. 1 with an outer layer removed from view and an inner layer engaged with an elastic band.
Figure 15:
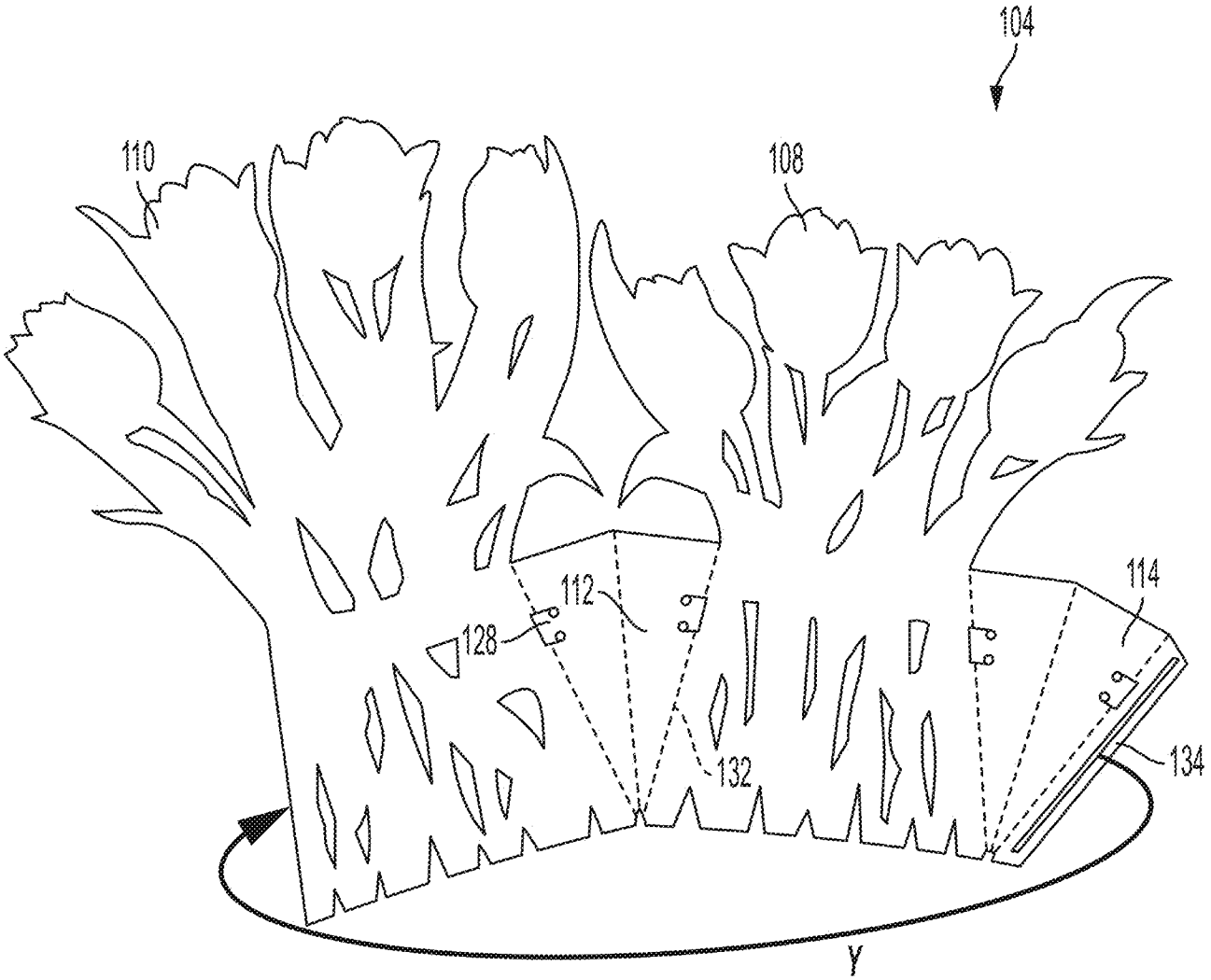
FIG. 15 illustrates a disassembled outer layer of a three-dimensional display according to some embodiments.
Figure 16:
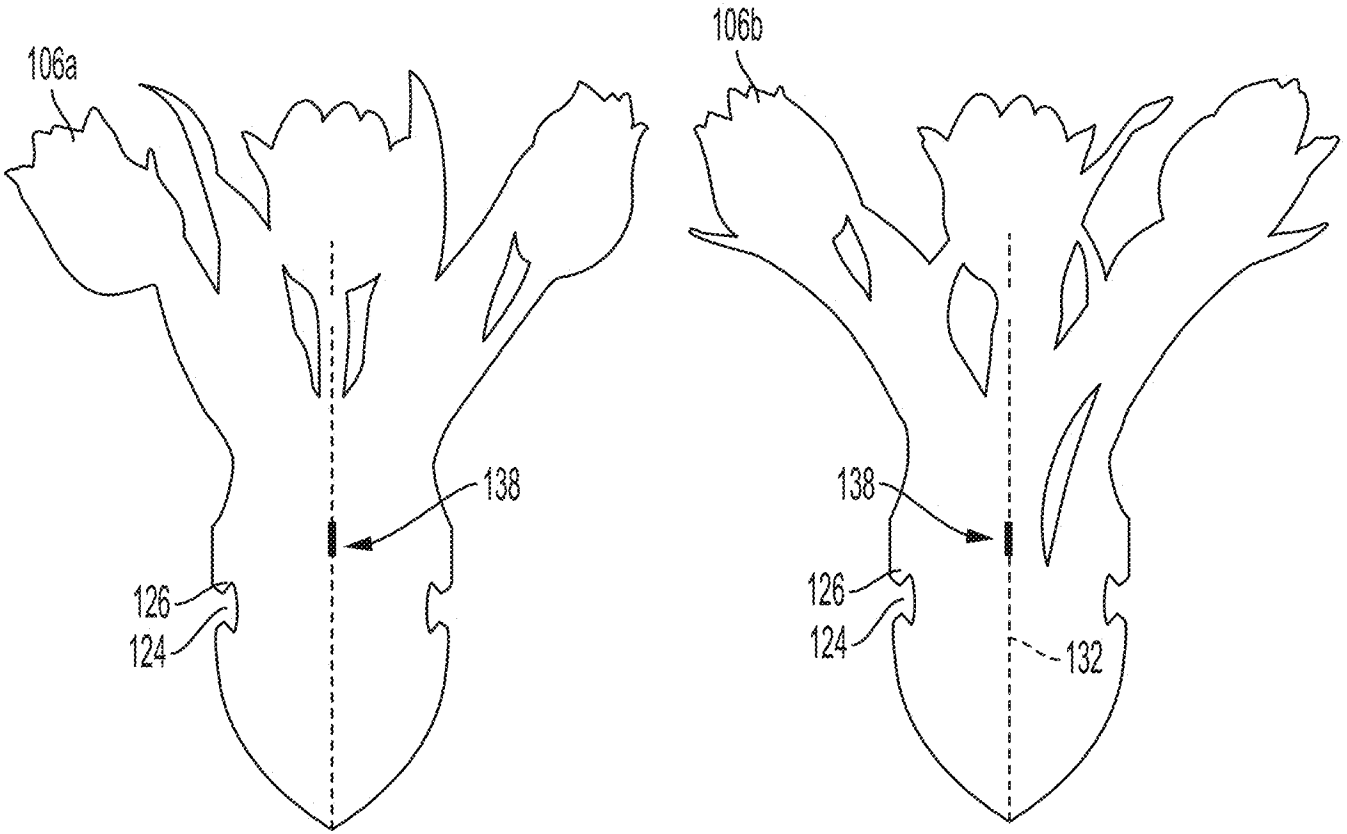
FIG. 16 shows disassembled inner layers of a three-dimensional display according to some embodiments.

In some embodiments, the elastic band(s) may be arranged to hold one or more inner panels to the outer panel. For example, as shown in FIG. 10 (see also FIG. 15), the inner panels 106*a*, 106*b* may each include one or more cutout 124 formed on the side walls to engage with the rubber bands. For example, as shown in FIG. 10 when the inner panels are inserted into the outer panel (see FIG. 11, with the direction of insertion shown by the arrow labeled X), the rubber band may pop into the first and second cutouts to hold the inner panel in the bouquet. As shown in FIG. 16, the cutout may decrease in size in a direction towards the outer edge of the side wall of the inner panel. In this regard, each cutout may include blocking surfaces 126 arranged to trap the elastic band in the respective cutout.

As shown in FIGS. 4, 5, and 7, when the inner layers are inserted into the outer layer and in an opened position, the inner layers may be arranged in an X-shape. In some embodiments, the elastic bands may cooperate with the inner layers to hold the inner layers in the X-shaped arrangement. In some embodiments, this X-shaped arrangement of the inner layers may encourage the outer layer to remain in the open position.

Figure 12:
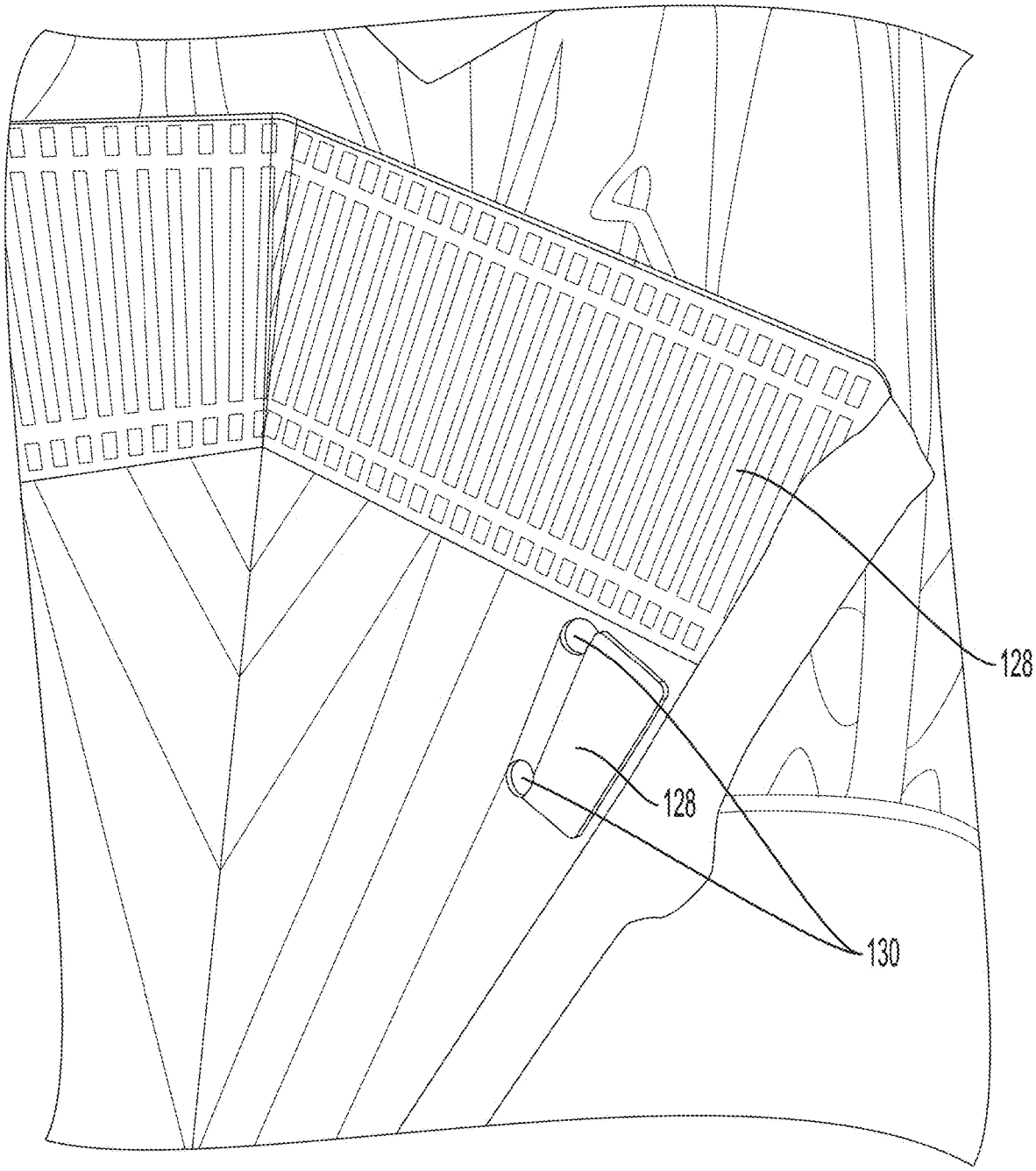
FIGS. 12-14 illustrate side views of a three-dimensional display and engagement of an elastic band with an outer layer of the display.
Figure 13:
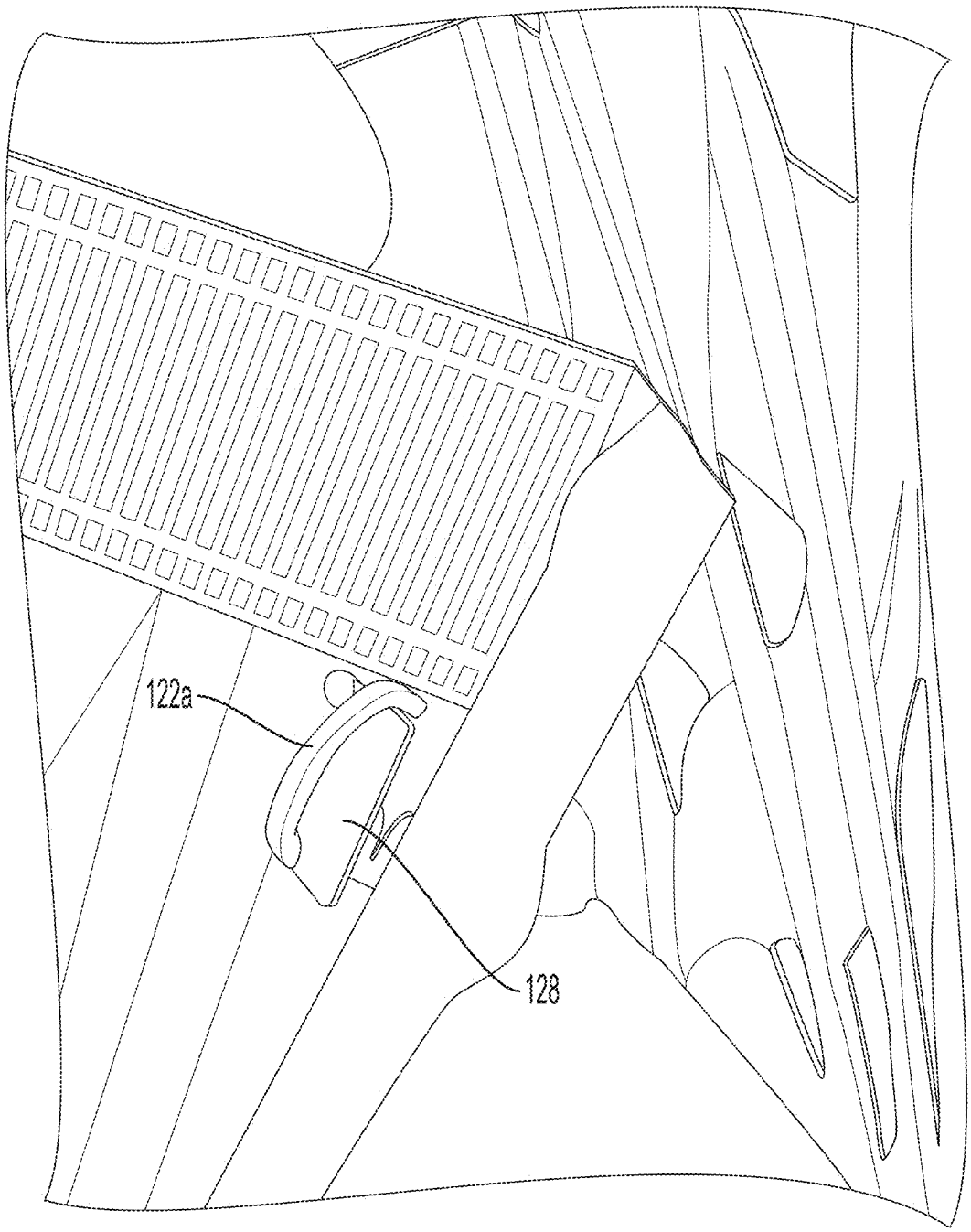
Figure 14:
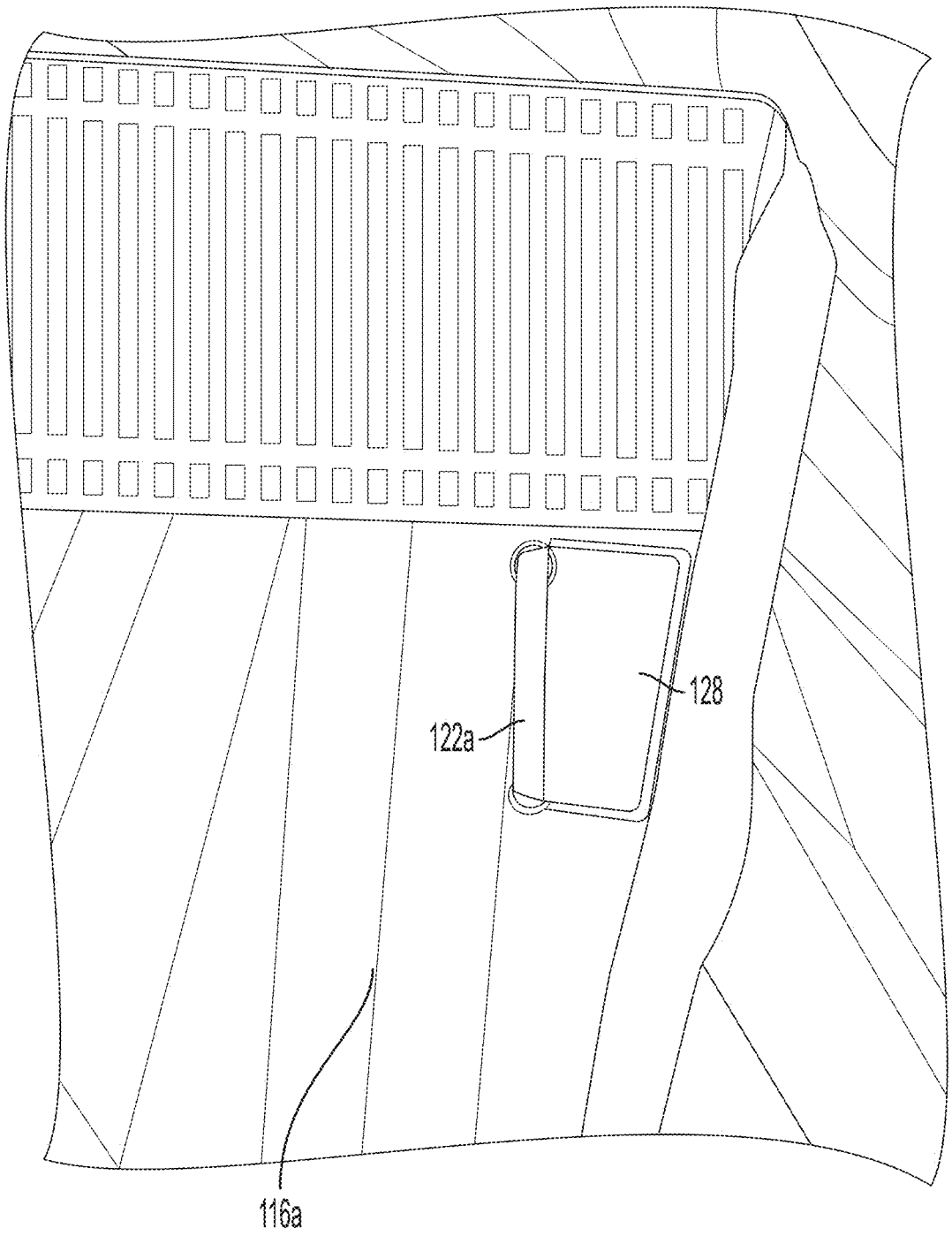

In some embodiments, the outer panel may include one or more features to hold (e.g., lock) the elastic band(s) to the outer panel, such as to the first and second segments of the side panels. For example, as shown in FIG. 12-14, the outer panel may include one or more tabs 128 engageable with the rubber bands. For example, a tab may be formed in each segments of the side panel to hold the elastic band to each segment and to the side panel. In some embodiments, as shown in FIG. 13, the elastic band 122 is insertable into an opening of the outer panel and over the respective tab 128. As shown in FIG. 12, the tab may include notches 130 into which the elastic band may be received (see FIG. 14) to hold the elastic band to the respective segment of the side panel when the elastic band is pulled taut around the tab.

As will be appreciated, the outer panel may include other arrangements to hold the elastic bands. For example, the outer panel may include one or more clips or other fasteners for holding the elastic band to the outer panel (e.g., to the side panel).

Figure 17A:
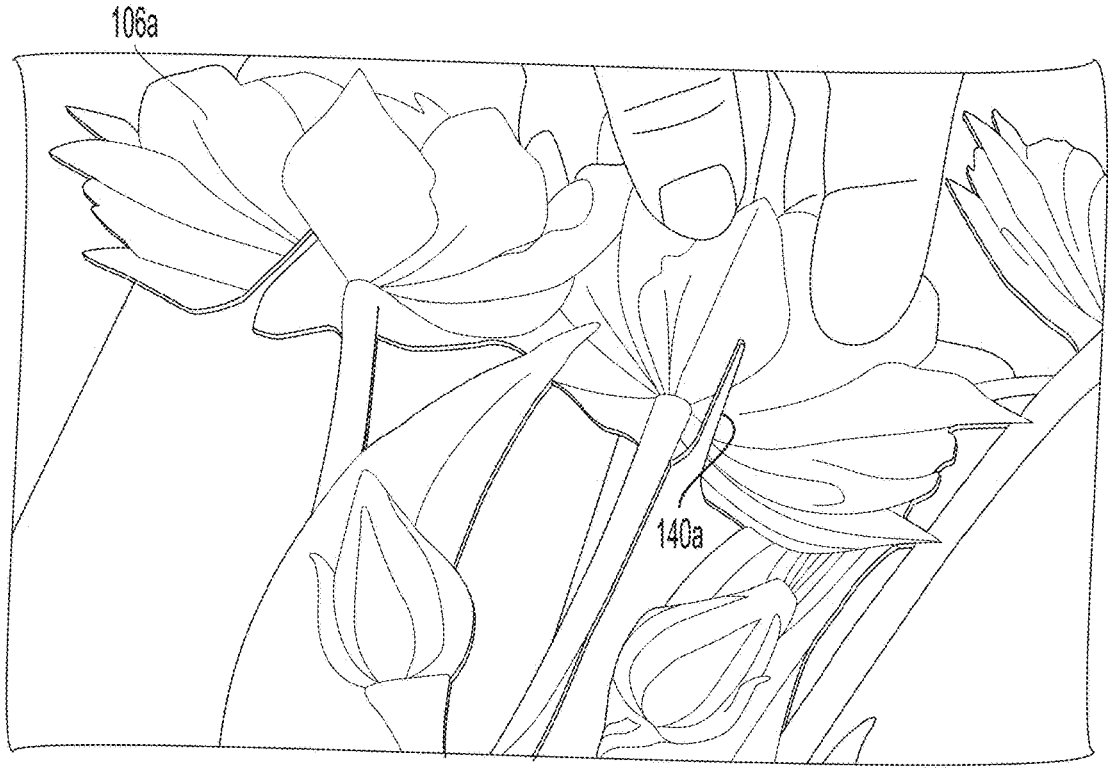
FIGS. 17A and 17B show disassembled inner layers of a three-dimensional display according to other embodiments.
Figure 17B:
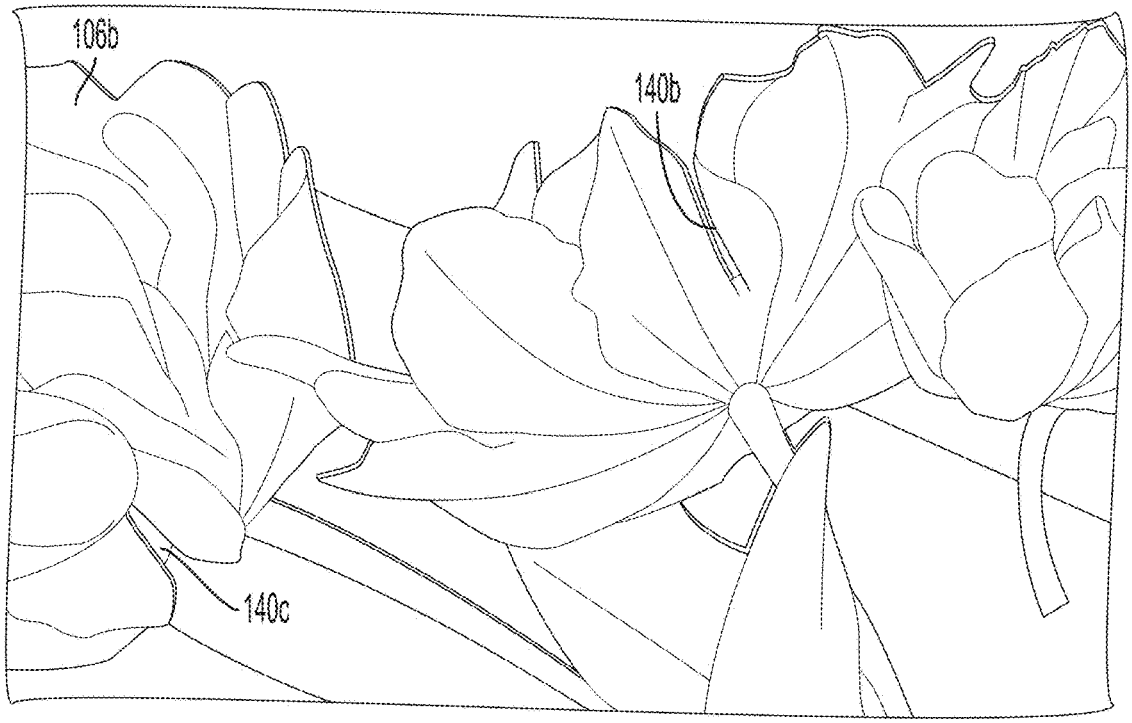

According to another aspect of the present disclosure, a method of creating a pop-open display (e.g., bouquet of flowers) is disclosed. In some embodiments, as shown in FIG. 15, the method may include forming the outer layer 104 of the bouquet, such as by die cutting the outer layer. As shown in FIG. 15, in some embodiments, the outer layer may include front 108 and rear 110 panels and side panels 112, 114. As will be appreciated, the outer layer also may be formed with only front and rear panels and one or more tabs for connecting the front and rear panels (see, e.g., FIG. 9). The method also includes forming the inner layer(s) of the bouquet (see FIG. 16), such as via die cutting. In some embodiments, the inner layers(s) are formed with cutouts for receiving the elastic band(s). The inner layer(s) also may include one or more slits (see, e.g., FIGS. 17A and 17B) for attaching to another inner layer or to the outer layer.

As will be appreciated, the inner and outer layers may be die cut from of a paper or plastic material of various weights. In some embodiments, the inner and outer layers may be formed of a flexible material. For example, in some embodiments, the inner and outer layers may be die cut from a piece of cardstock with printed images arranged to look like flowers having stems and leaves. As will be appreciated, one or more embellishments may be added to the inner and/or outer layers. For example, in some embodiments, a piece of ribbon, glitter, or even fake flowers, may be added to the cardstock. In other embodiments, only a portion of the flowers, such as the leaves and stem die cut from a paper material, with other portions of the flowers formed via other methods and attachable to the die cut portion. In some embodiments, at least a portion of the bouquet may be formed of a transparent or translucent plastic material.

As shown in FIG. 15, the outer layer may be formed with one on more tabs 128, which are engageable with the elastic bands (see FIGS. 12-14). In some embodiments, the outer layer may include one or more fold lines 132 along which the outer layer is foldable to create one or more panels, such as to create the side panels and the first and second segments of each side panel. In some embodiments, the outer layer also includes an attachment panel 134 along which an adhesive is applied. As will be appreciated, the adhesive may include glue, tape, or another suitable adhesive.

Next, the method may include attaching one or more elastomeric members (e.g., elastic bands to the outer layer). For example, the method may include inserting the bands into openings in the outer layer and around the respective tabs (see FIGS. 12-14). In some embodiments, attaching the one or more elastic bands includes attaching first and second elastic bands to the side panels. In some embodiments, a first elastic band is attachable to the first segment of each side panel, and the second elastic band is attachable to the second segment of each side panel.

After attaching the elastomeric members, the method may include assembling the outer layer of the bouquet. In some embodiments the method includes moving the attachment panel around and over an outer-facing side of the rear panel 110 of the outer layer (see the arrow labeled Y in FIG. 15) and attaching the attachment panel to the rear panel. In some embodiments, attaching the attachment panel includes attaching the panel via the adhesive (e.g., glue) previously applied thereto. In other embodiments, the attachment panel may be attached to the rear panel via one or more fasteners (e.g., staples) inserted after the attachment panel is placed over the outer-facing side of the rear panel. In such embodiments, the attachment panel need not include an adhesive.

Although the attachment panel is shown being attached to a side panel for attachment to the rear panel of the outer layer, it will be appreciated that the attachment panel may be attached to another portion of the outer layer for assembling the outer layer. For example, the attachment panel may be attachable to the rear panel for attachment to a side panel in other embodiments.

As will be appreciated, although the assembling step is described as happening after the step by which the elastomeric members (e.g., rubber bands) are attached, in other embodiments, the outer layer may be assembled prior to attachment of the elastomeric members (e.g., rubber bands).

Next, the method includes attaching the inner layers to one another. In some embodiments, attaching the inner layers includes stacking the inner layers and applying a staple 138 (see FIG. 16). Attaching the inner layers also may include engaging one or more slits 140*a* formed in the flowers of the first inner layer 106*a* with one or more slits 140*b* on the flowers of the second inner layer 106*b*. As will be appreciated, slits may be formed in only some of the flowers on the inner layers in some embodiments. Slits also may be formed in the leaves and/or stems in some embodiments. As shown in FIG. 16, the inner layers also may include fold lines such that the inner layers may be arranged in an X-shape after the first and second layers are attached to one another.

Figure 11:
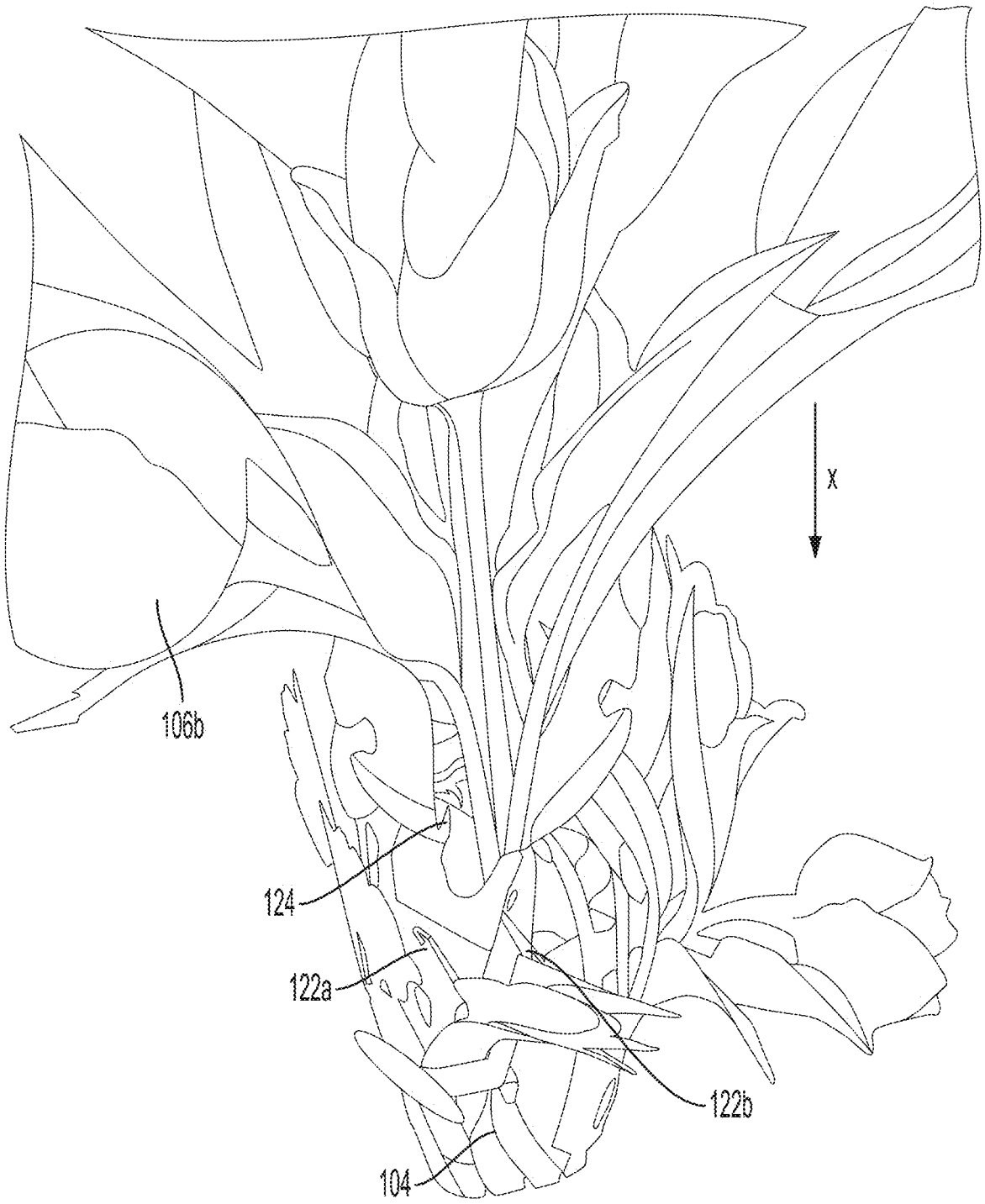
FIG. 11 illustrates inner layers being inserted into an outer layer of a three-dimensional display.

The method further includes inserting the inner layers into the outer layer. For example, as shown in FIG. 11 (see the arrow labeled X), the inner layers are insertable into a top of the outer layer. In some embodiments, the method includes attaching the inner layers to the outer layer. For example, the method includes attaching the inner layers to the elastic band(s) attached to the outer layer (see, e.g., FIG. 10). In some embodiments, this may include inserting the elastic bands into cutouts formed in the outer sides of the inner layers. In other embodiments, this may include engaging slits 140*c* on the flowers (and/or stems) of the inner layers (see FIG. 17B) with corresponding slits on the outer layer. In some embodiments, upon attachment to the outer layer, the inner layers may be arranged in an X-shape.

Figure 18:
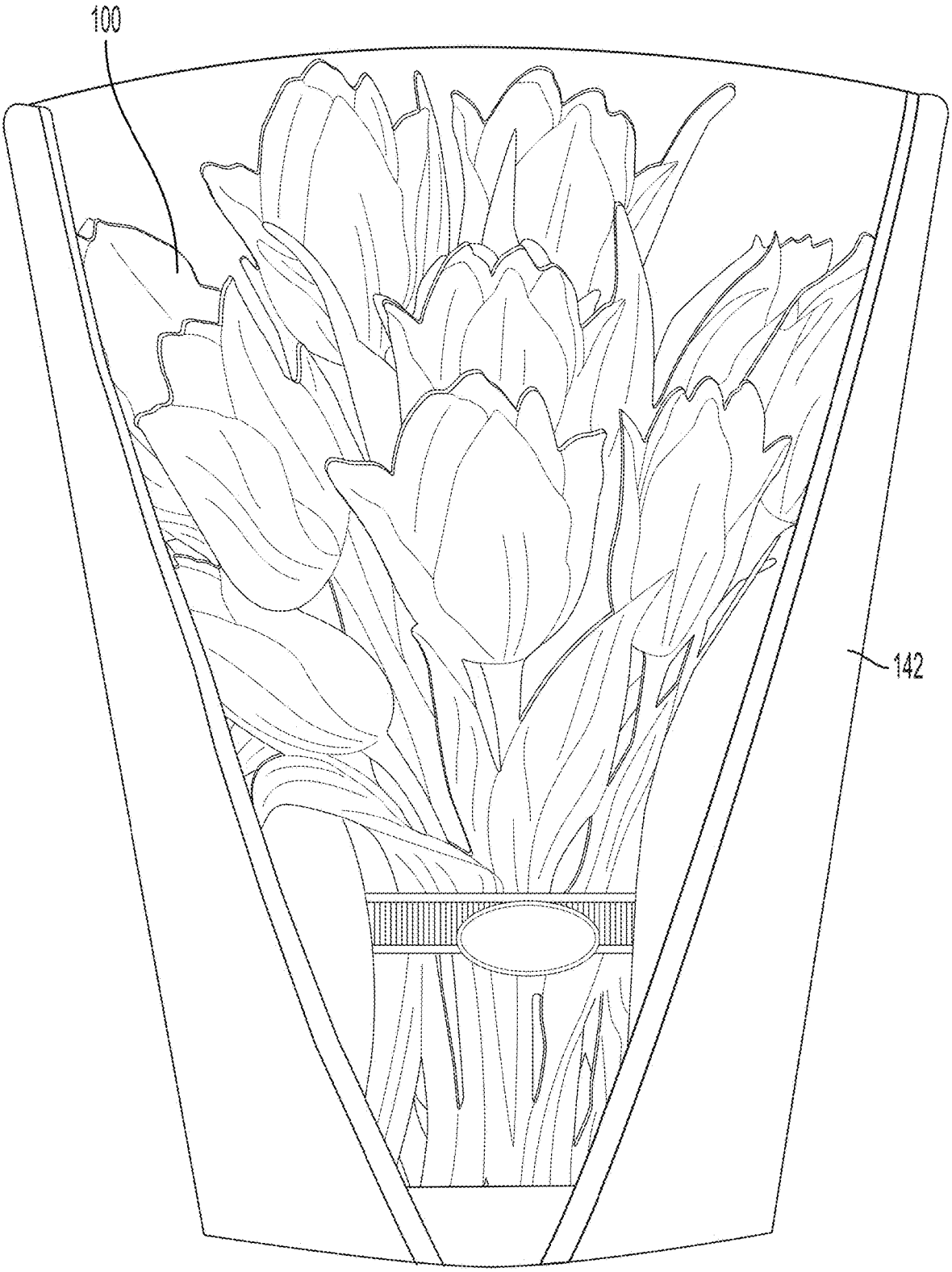
FIG. 18 shows a three-dimensional display in a holder according to some embodiments.
Figure 19:
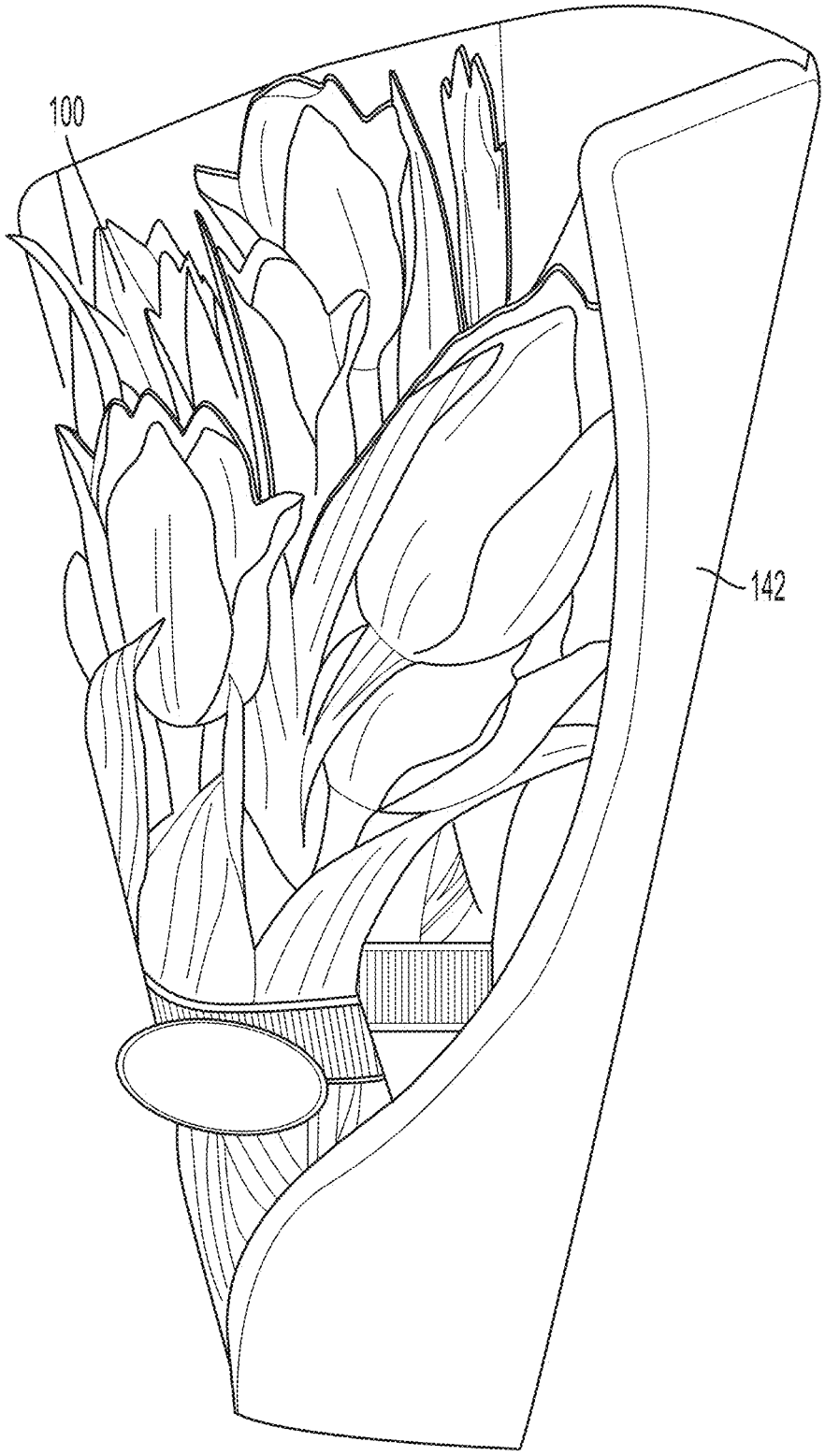
FIG. 19 shows a popped open three-dimensional display in a holder according to some embodiments.

In some embodiments, the method may include collapsing the pop-up bouquet and inserting the bouquet into a holder. In some embodiments, as shown in FIGS. 18 and 19, the holder may be designed to look like a vase. As shown in FIG. 19, in some embodiments, the holder 142 also may be arranged to be at least partially popped open when the bouquet is popped open. In some embodiments, the holder and bouquet are insertable into and envelope (not shown) for sending (e.g., mailing) the bouquet to a recipient.

Figure 20:
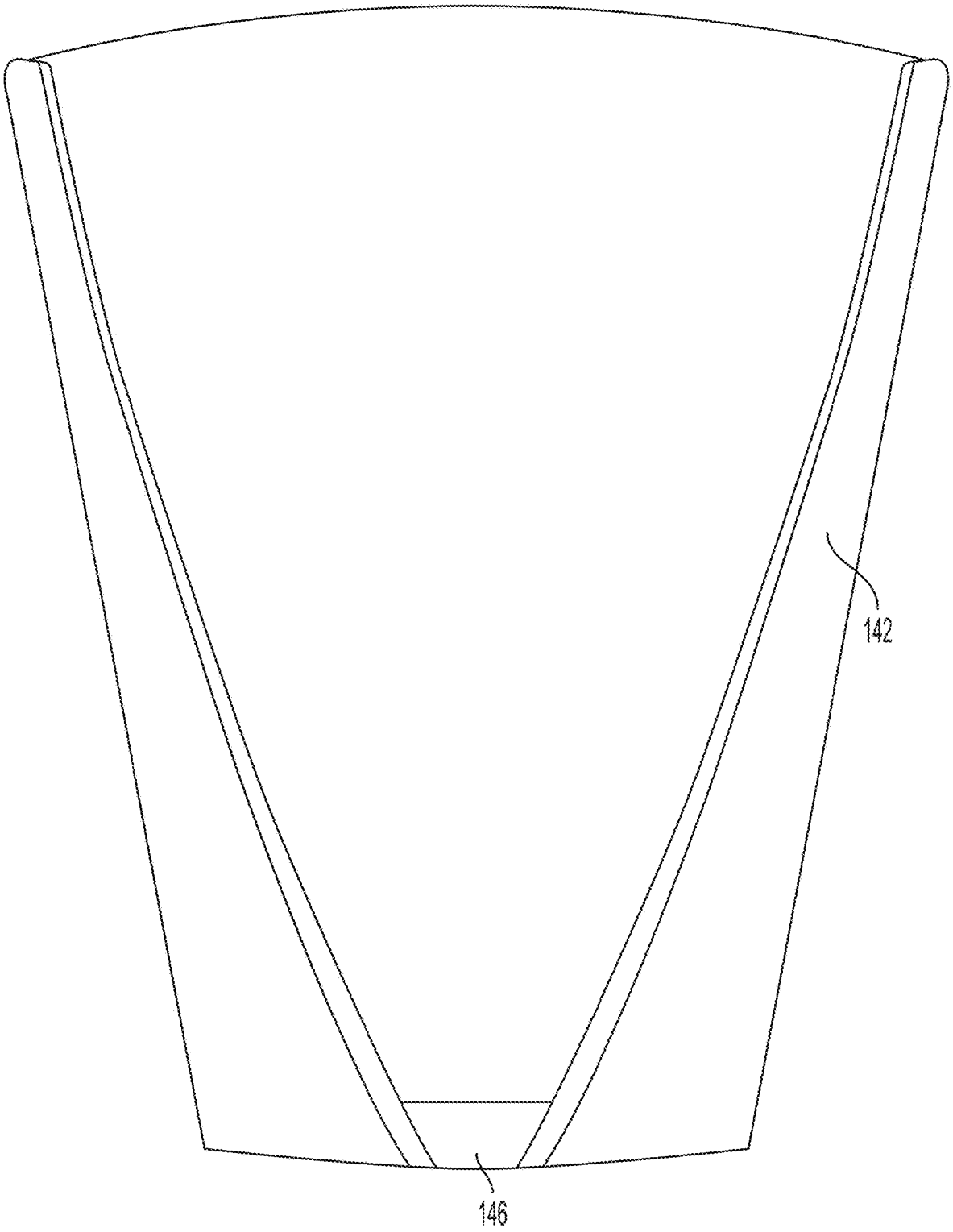
FIG. 20 shows the holder of FIG. 18 without a display.
Figure 21:
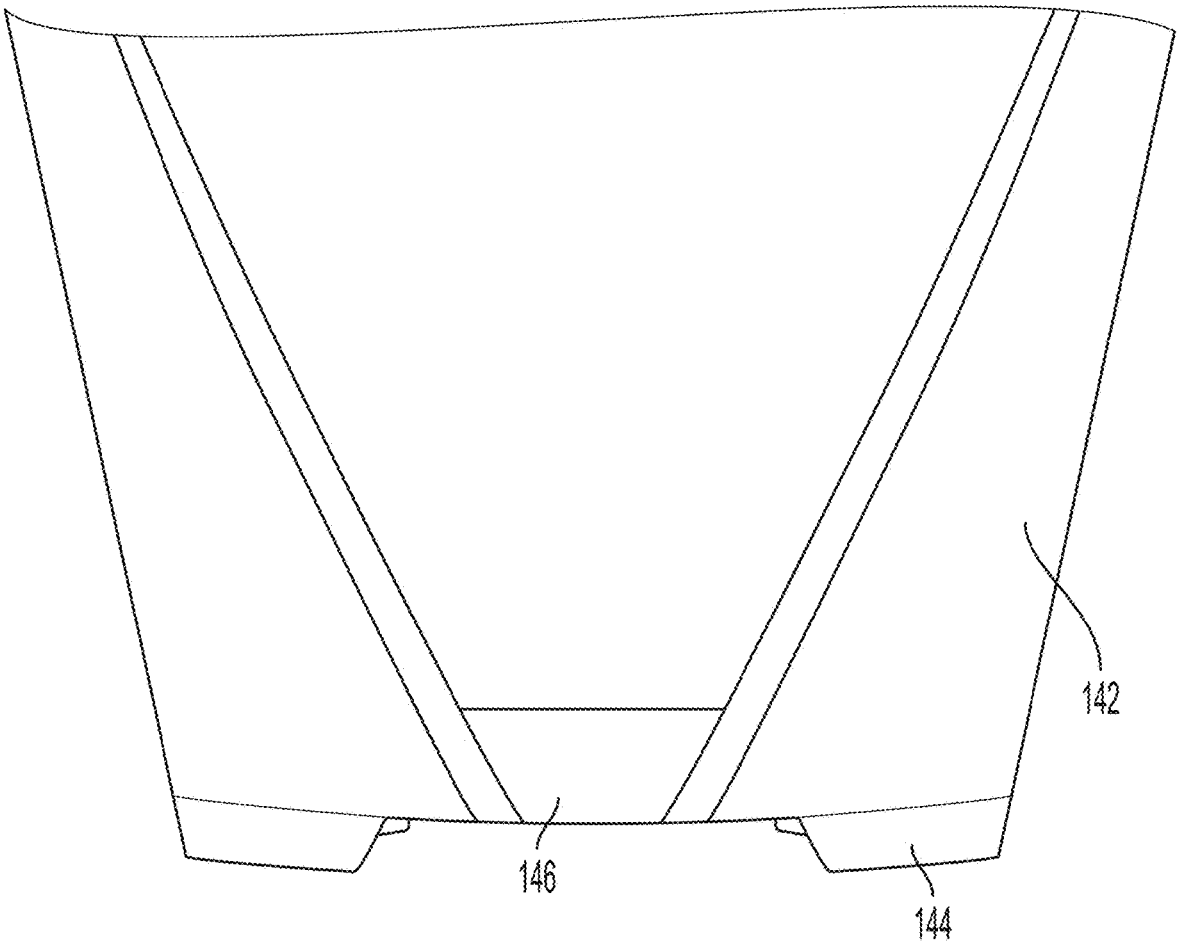
FIG. 21 shows a bottom portion of the holder of FIG. 18.
Figure 22:
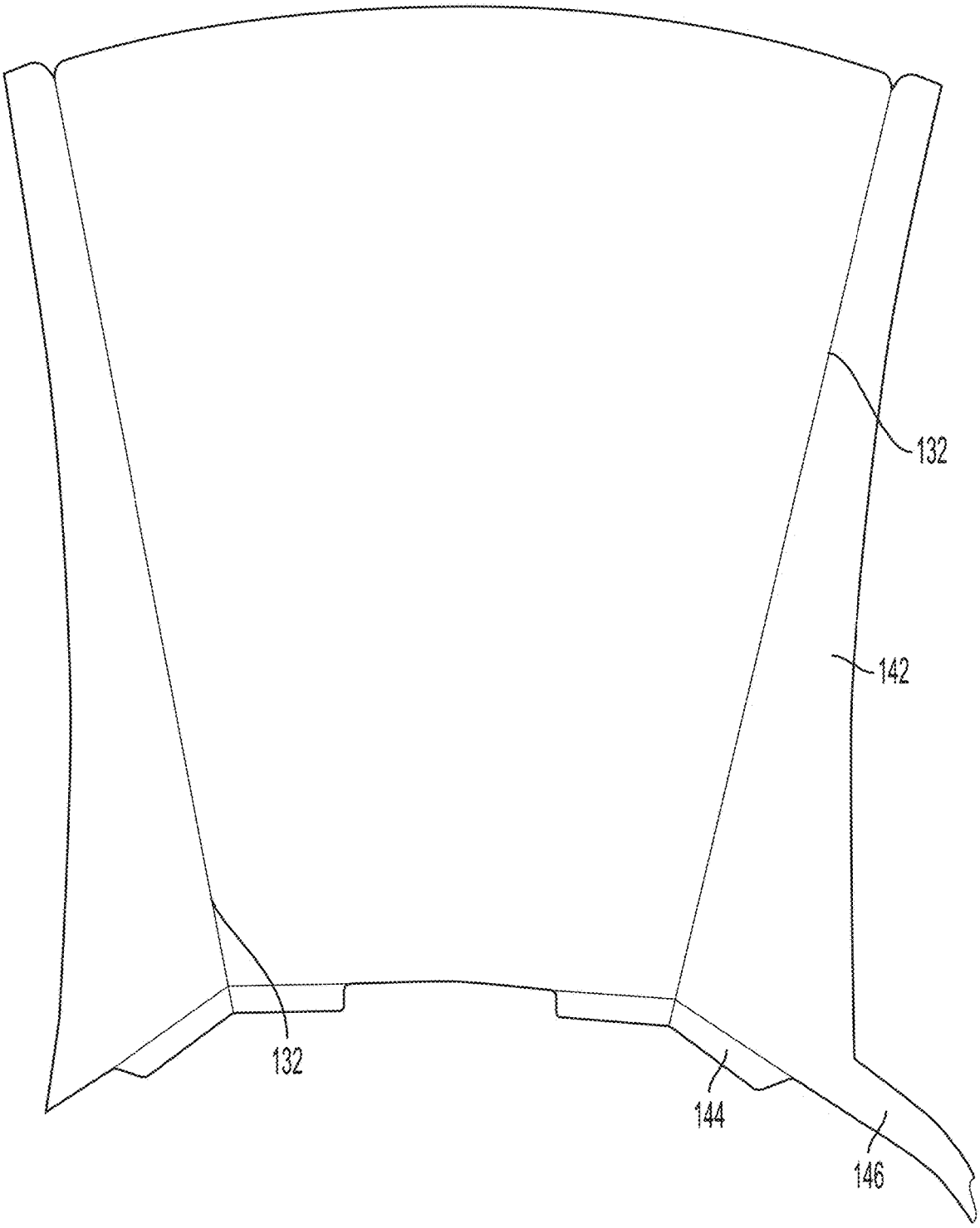
FIG. 22 shows the holder of FIG. 18 in a disassembled configuration.
Figure 23:
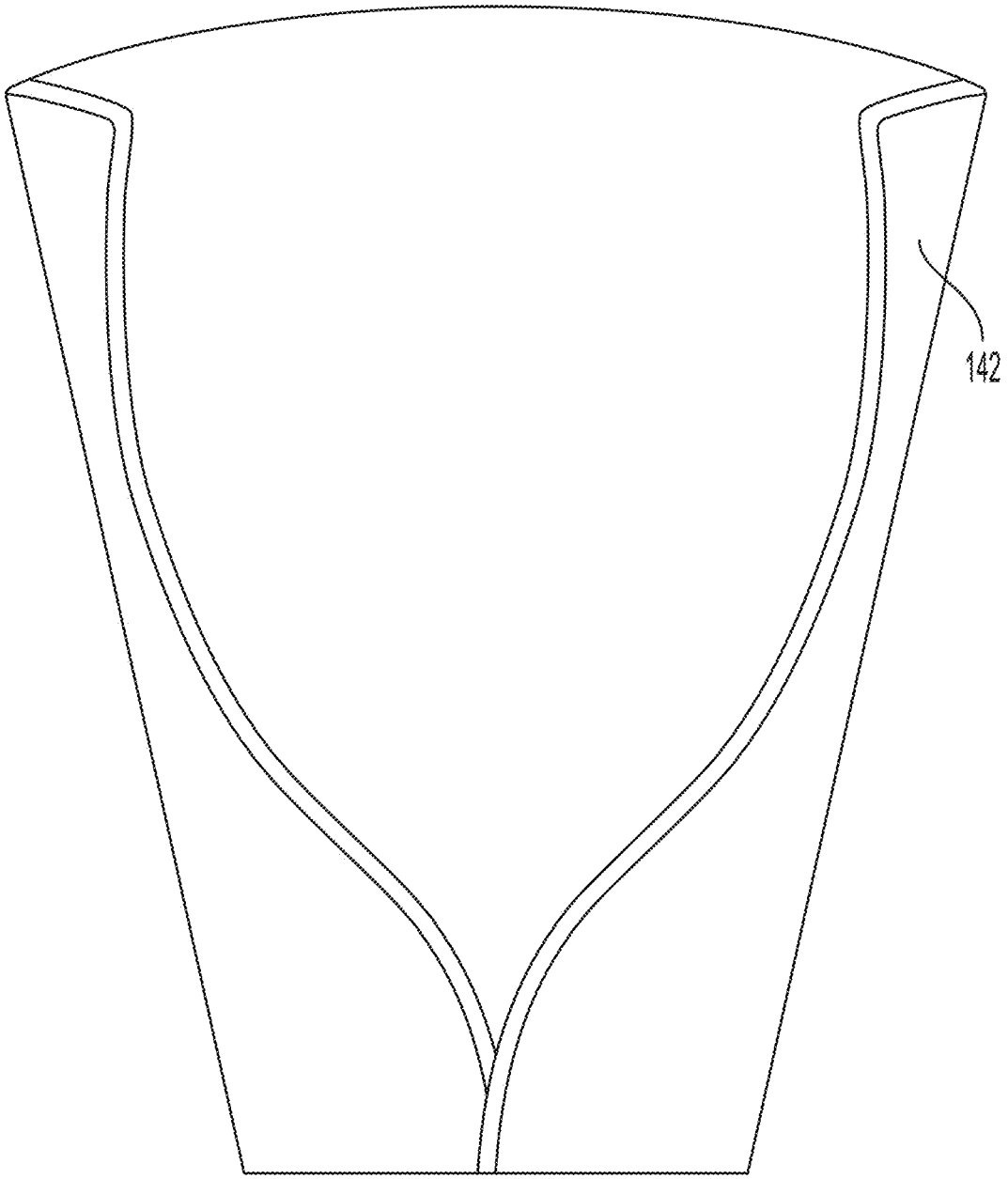
FIG. 23 shows a holder according to another embodiment.

In some embodiments, as shown in FIGS. 20-22, the holder may include one or more tabs 144 arranged to hold the bouquet in the holder. For example, as shown in FIG. 20, the tabs may be folded upwardly and into the holder and act as a ledge upon which the bouquet may rest.

In some embodiments, as shown in FIG. 22, the holder may be formed similar to the outer layer, such as via die cutting. The holder also may include one or more fold lines such that the holder may be formed to include one or more front panels and a rear panel. The holder also includes one or more tabs arranged to form the ledge for holding the bouquet in the holder.

Figure 24:
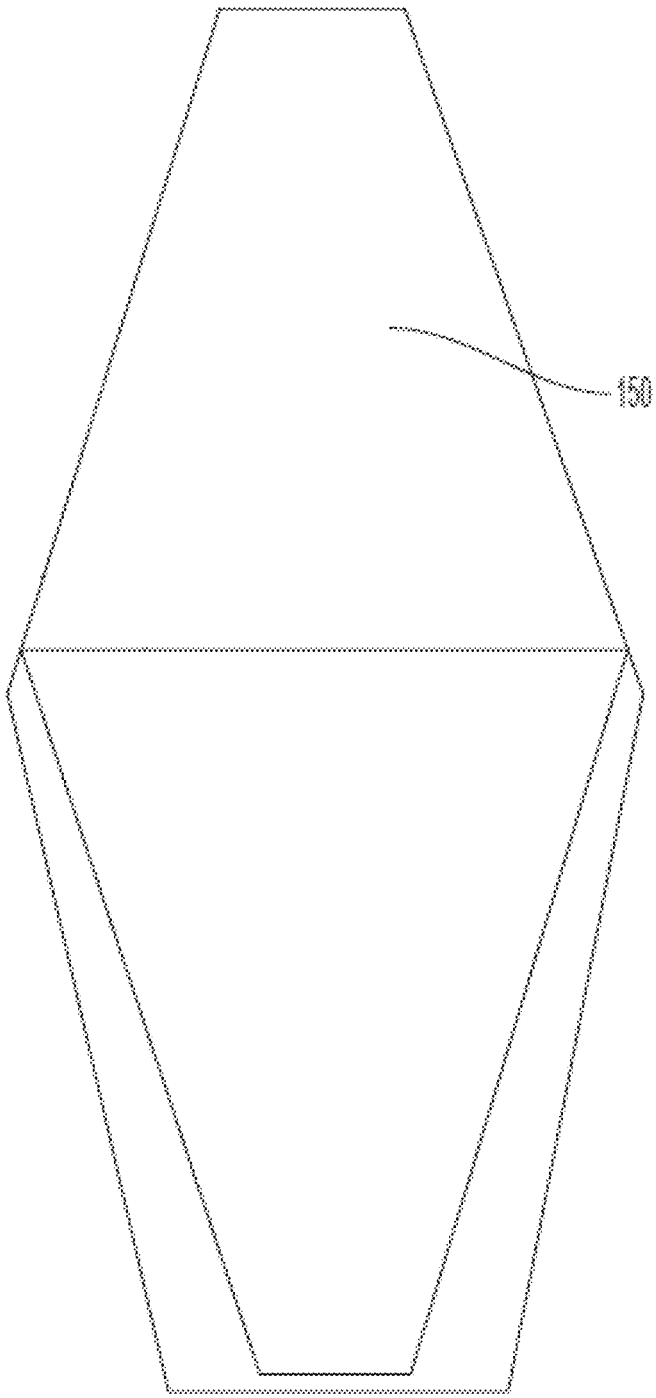
FIG. 24 shows a holder according to still another embodiment.

In some embodiments, as shown in FIG. 22, the holder also includes an attachment tab 146 which may include an adhesive, the attachment tab being moveable over, and thereafter attachable to, an outer facing side of the holder. As shown in FIG. 21, in some embodiments, the attachment tab may for a portion of a front of the holder. In other embodiments, the attachment tab may be positioned behind the front panel(s) of the holder (see, e.g., FIG. 23). As will be appreciated, the front panels of the holder also may be attached to one another in other suitable manners. As will be appreciated, the holder may have other suitable arrangements in other embodiments. For example, as shown in FIGS. 18-20 and 23, the holder may be formed with front and rear panels and a pocket into which the bouquet is insertable. In some embodiments, the holder may have a cover 150 to hide the bouquet until opened by the recipient (see FIG. 24).

Although embodiments are shown and described with pop-open flower bouquets and pop-open balloon bouquet, it will be appreciated that the pop-open display may include other suitable arrangements. For example, in some embodiments, the 3D display may include a pop-open cake, a pop-open decoration for an event (e.g., decals or characters from books, television, and/or movies).

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A three-dimensional display arranged to be popped open, the three- dimensional display comprising:

an outer layer having printed images;

first and second inner layers having printed images, wherein the first and second inner layers are attached to one another and the first inner layer and the second inner layer form an X-shape when attached to one another and when the three-dimensional display is in an open position, wherein each of the first and second inner layers include a first sidewall and a second sidewall, and wherein each of the first and second sidewalls of each of the first and second inner layers includes a cutout; and elastomeric members attachable to at least the outer layer, the elastomeric members including a first elastomeric member and a second elastomeric member, both arranged to pop open and/or hold the three-dimensional display in the open position, wherein the first elastomeric member is arranged to be received by the cutout of at least one of the first sidewall and the second sidewall of the first inner layer, and the second elastomeric member is arranged to be received by the cutout of at least one of the first sidewall and the second sidewall of the second inner layer.

2. The three-dimensional display of claim 1, wherein each of the first and second elastomeric members include rubber bands.

3. The three-dimensional display of claim 1, wherein the outer layer includes a front panel and a rear panel.

4. The three-dimensional display of claim 3, wherein the outer layer includes first and second side panels.

5. The three-dimensional display of claim 4, wherein the first elastomeric member is attached to each of the first and second side panel and the second elastomeric member is attached to each of the first and second side panel.

6. The three-dimensional display of claim 4, wherein each of the first and second side panels extends inwardly towards a center of the three-dimensional display.

7. The three-dimensional display of claim 6, wherein each of the first and second side panels is substantially V-shaped.

8. The three-dimensional display of claim 1, wherein each cutout includes a blocking surface.

9. The three-dimensional display of claim 1, wherein the printed images of the outer layer and the first and second inner layers includes flowers.

10. A method of forming a three-dimensional display arranged to be popped open, the method comprising:

forming an outer layer having printed images;

attaching one or more elastomeric members to the outer layer, the elastomeric members including a first elastomeric member and a second elastomeric member;

assembling one or more inner layers having printed images, wherein the one or more inner layers includes a first inner layer and a second inner layer, wherein assembling the one or more inner layers includes attaching the first and second inner layers to one another and the first inner layer and the second inner layer form an X-shape when attached to one another and when the three-dimensional display is in an open position, wherein each of the first and second inner layers include a first sidewall and a second sidewall, and wherein each of the first and second sidewalls of each of the first and second inner layers includes a cutout; and inserting the one or more inner layers into the outer layer, wherein the first elastomeric member is arranged to be received by the cutout of at least one of the first sidewall and the second sidewall of the first inner layer, and the second elastomeric member is arranged to be received by the cutout of at least one of the first sidewall and the second sidewall of the second inner layer.

11. The method of claim 10, wherein assembling the outer layer includes attaching a first side panel of the outer layer to a rear panel of the outer layer.

12. The method of claim 10, wherein forming the outer layer includes die cutting the outer layer.

13. The method of claim 10, further comprising attaching the first and second inner layers to the outer layer.

14. The method of claim 13, wherein attaching the first and second inner layers to the outer layer includes engaging the first and second inner layers with the elastomeric members.

15. The method of claim 10, wherein attaching the one or more elastomeric members includes attaching first and second rubber bands to the outer layer, the first rubber band being attachable to each of a first side panel and a second side panel of the outer layer, and the second rubber band being attachable to each of the first and second side panels.

16. The method of claim 10, wherein the printed images of the outer layer and the first and second inner layers includes flowers.

17. The method of claim 10, further comprising popping open the three-dimensional display.

* * * * *